US009057988B2

(12) United States Patent
Nakayama et al.

(10) Patent No.: US 9,057,988 B2
(45) Date of Patent: Jun. 16, 2015

(54) DEVELOPING DEVICE AND IMAGE FORMING APPARATUS

(71) Applicant: Konica Minolta, Inc., Chiyoda-ku (JP)

(72) Inventors: Kanji Nakayama, Toyokawa (JP); Wataru Onoda, Suginami-ku (JP); Hiroaki Takada, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/132,120

(22) Filed: Dec. 18, 2013

(65) Prior Publication Data

US 2014/0169839 A1 Jun. 19, 2014

(30) Foreign Application Priority Data

Dec. 19, 2012 (JP) ..... 2012-276624

(51) Int. Cl.
*G03G 15/09* (2006.01)

(52) U.S. Cl.
CPC ..... *G03G 15/0921* (2013.01)

(58) Field of Classification Search
CPC ..... G03G 15/0921; G03G 15/0812
USPC ..... 399/274, 275, 277
See application file for complete search history.

(56) References Cited

U.S. PATENT DOCUMENTS

2004/0190947 A1* 9/2004 Takeuchi et al. ..... 399/274
2008/0056747 A1* 3/2008 Miyoshi ..... 399/58
2008/0181676 A1* 7/2008 Yamagishi et al. ..... 399/275
2011/0170916 A1* 7/2011 Sakamaki et al. ..... 399/274
2012/0076540 A1* 3/2012 Suzuki et al. ..... 399/274 X

FOREIGN PATENT DOCUMENTS

JP 9-222792 A 8/1997
JP 10-31366 A 2/1998
JP H10-333431 A 12/1998
JP 2008-216817 A 9/2008
JP 2009-265358 A 11/2009

OTHER PUBLICATIONS

Japanese Notification of Reasons for Refusal dated Feb. 3, 2015 issued in the corresponding Japanese Patent Application No. 2012-276624 and English translation (7 pages).

* cited by examiner

*Primary Examiner* — Sophia S Chen
(74) *Attorney, Agent, or Firm* — Buchanan Ingersoll & Rooney PC

(57) ABSTRACT

A developing device having: a developing sleeve in which a magnetic member is inserted, transporting two-component developer to a developing area facing an image carrier; and a restriction member for restricting the amount of developer to be no greater than 250 g/m$^2$. The average of absolute values of magnetic flux density within a restriction area falls within a range of 40 mT to 70 mT under a condition that no developer exists within the restriction area. The restriction area extends along the outer circumferential surface between a closest point on the outer circumferential surface, which is closest to the restriction member, and a point 2 mm upstream from the closest point in a rotational direction of the developing sleeve, and has a height that is half a minimum distance between the closest point and the restriction member.

5 Claims, 27 Drawing Sheets

FIG. 10

| | | Practical example | | Comparative example | |
|---|---|---|---|---|---|
| | | Carrier adhesion | Lead off | Carrier adhesion | Lead off |
| T/C ratio | 1% | ○ | △ | × | △ |
| | 2% | ○ | △ | × | ○ |
| | 3% | ○ | ○ | × | ○ |
| | 4% | ○ | ○ | ○ | ○ |
| | 5% | ○ | ○ | ○ | ○ |
| | 6% | ○ | ○ | ○ | ○ |
| | 7% | ○ | ○ | ○ | ○ |
| | 8% | ○ | ○ | ○ | △ |
| | 9% | ○ | ○ | ○ | × |

Normal

Occurrence of lead off

FIG. 13

| | Experimental conditions | | | | | Experimental results | | |
|---|---|---|---|---|---|---|---|---|
| | Outer diameter of developing sleeve | Shape of restriction member | Particle size of magnetic carrier | Mg magnetic force / Restriction position | Distance Db | Average Density $\lvert B_m \rvert$ | Carrier adhesion occurrence frequency | Volume change ratio of developer |
| Condition 1 | φ16 | Plate-like | 30 μm | A-1 | 0.42 | 30.1 | 76% | N/A |
| | 〃 | 〃 | 〃 | 〃 | 〃 | 30.1 | 58% | 0.53 |
| | 〃 | 〃 | 〃 | 〃 | 〃 | 30.1 | 64% | 0.59 |
| Condition 2 | 〃 | 〃 | 〃 | A-2 | 0.43 | 32.6 | 4% | 0.30 |
| Condition 3 | 〃 | 〃 | 〃 | 〃 | 0.50 | 36.2 | 3% | N/A |
| Condition 4 | 〃 | 〃 | 〃 | A-3 | 0.48 | 32.6 | 3% | 0.34 |
| Condition 5 | 〃 | 〃 | 〃 | 〃 | 0.50 | 33.3 | 12% | N/A |
| Condition 6 | 〃 | 〃 | 〃 | A-4 | 0.43 | 42.2 | 0% | N/A |
| Condition 7 | 〃 | 〃 | 〃 | A-5 | 〃 | 44.4 | 0% | N/A |
| Condition 8 | 〃 | 〃 | 〃 | A-6 | 〃 | 44.0 | 0% | N/A |
| Condition 9 | 〃 | 〃 | 〃 | B-2 | 0.50 | 56.4 | 0% | N/A |
| Condition 10 | 〃 | 〃 | 〃 | B-4 | 〃 | 72.3 | 2% | -0.39 |
| Condition 11 | 〃 | 〃 | 〃 | B-5 | 〃 | 62.4 | N/A | -0.11 |
| Condition 12 | 〃 | 〃 | 33 μm | B-2 | 0.50 | 56.4 | 0% | -0.04 |
| | 〃 | 〃 | 〃 | 〃 | 〃 | 56.4 | 0% | -0.03 |
| | 〃 | 〃 | 〃 | 〃 | 〃 | 56.4 | N/A | -0.02 |
| | 〃 | 〃 | 〃 | 〃 | 〃 | 56.4 | N/A | -0.09 |
| Condition 13 | 〃 | 〃 | 〃 | B-3 | 0.55 | 69.0 | 0% | N/A |
| Condition 14 | 〃 | 〃 | 〃 | 〃 | 0.50 | 67.1 | N/A | -0.15 |
| Condition 15 | 〃 | 〃 | 〃 | B-4 | 0.55 | 78.0 | 8% | N/A |
| Condition 16 | 〃 | 〃 | 〃 | C-1 | 0.50 | 62.4 | 0% | N/A |
| Condition 17 | 〃 | 〃 | 〃 | C-2 | 〃 | 45.9 | 0% | N/A |
| Condition 18 | 〃 | 〃 | 〃 | C-3 | 〃 | 39.6 | 0% | 0.25 |
| | 〃 | 〃 | 〃 | 〃 | 〃 | 39.6 | 0% | 0.23 |
| Condition 19 | 〃 | Cylindrical | 30 μm | A-1 | 0.50 | 26.0 | 86% | N/A |
| Condition 20 | 〃 | 〃 | 〃 | A-2 | 〃 | 36.0 | 1% | 0.39 |
| | 〃 | 〃 | 〃 | 〃 | 〃 | 36.0 | N/A | 0.28 |
| Condition 21 | 〃 | 〃 | 〃 | A-4 | 0.50 | 43.6 | N/A | 0.19 |
| | 〃 | 〃 | 〃 | 〃 | 〃 | 43.6 | N/A | 0.08 |
| Condition 22 | 〃 | 〃 | 〃 | A-6 | 0.48 | 43.6 | 0% | N/A |
| Condition 23 | 〃 | 〃 | 〃 | 〃 | 〃 | 48.8 | 0% | -0.02 |
| | 〃 | 〃 | 〃 | 〃 | 〃 | 48.8 | 0% | N/A |
| | 〃 | 〃 | 〃 | 〃 | 0.55 | 48.8 | 0% | N/A |
| Condition 24 | φ12 | Plate-like | 30 μm | D-2 | 0.50 | 53.5 | 0% | 0.03 |
| Condition 25 | 〃 | 〃 | 〃 | D-4 | 〃 | 61.8 | 0% | -0.02 |

FIG. 14
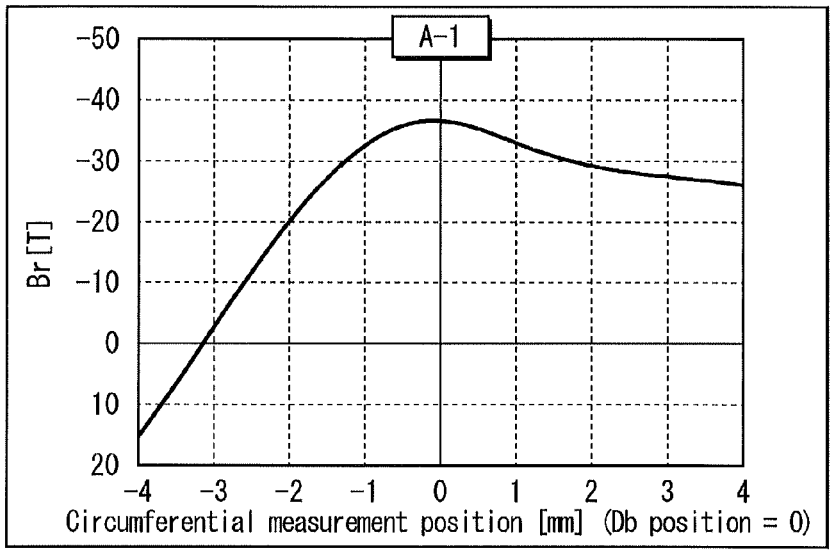
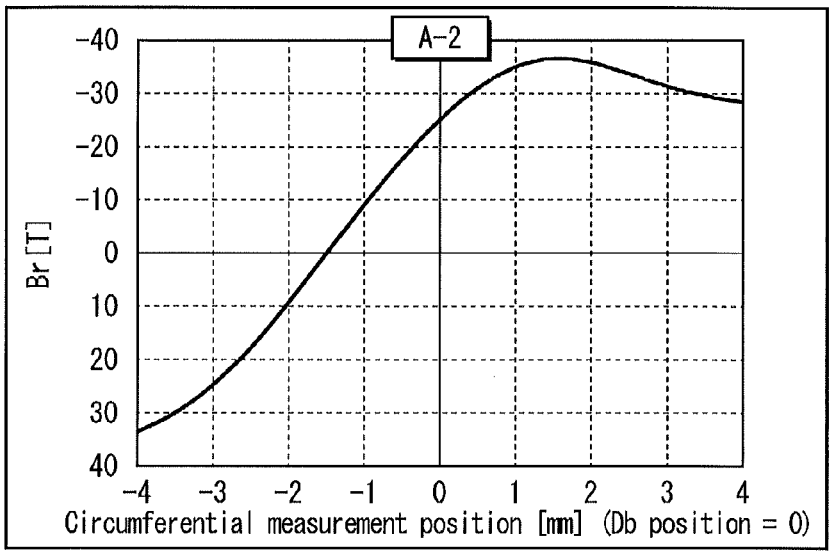
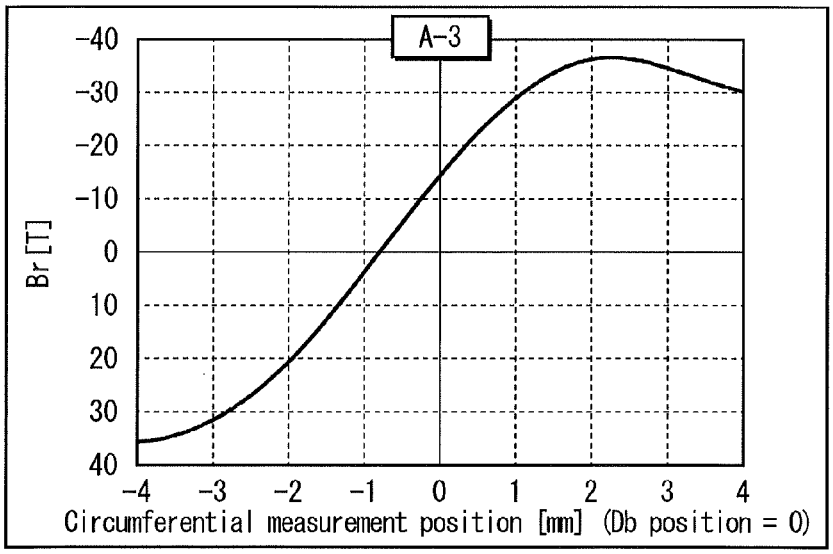

Minimum distance DS is small

Minimum distance DS is large

DEVELOPING DEVICE AND IMAGE FORMING APPARATUS

CROSS-REFERENCE TO RELATED APPLICATIONS

This application is based on application No. 2012-276624 filed in Japan, the contents of which are hereby incorporated by reference.

BACKGROUND OF THE INVENTION (1) Field of the Invention

The present invention relates to developing devices and image forming apparatuses, and in particular to a technology of preventing an image formation failure occurring in a developing device using a two-component developer due to the change in the ratio between the amount of toner and the amount of magnetic carrier.

(2) Related Art

A developing device used in an image forming apparatus develops an electrostatic latent image formed on the outer circumferential surface of the photosensitive drum by using toner stored in the device. The amount of the consumption of the toner depends on the area and the density of the electrostatic latent image. In particular, when a developing device using two-component developer containing toner and magnetic carrier develops an electrostatic latent image that requires a large amount of toner, the amount of the toner stored in the developing device greatly decreases, and accordingly the ratio of the toner in the developer (hereinafter referred to as "T/C ratio") greatly decreases. If the fluctuation range of the T/C ratio is large, the amount of charge per unit weight of the developer (hereinafter referred to as "toner charge amount") and the magnetic property and flowability of the developer also greatly change, and accordingly the amount of the developer transported by the developing sleeve greatly changes as well.

If the amount of the developer transported by the developing sleeve becomes too much according to the change in the T/C ratio, it would be possible that a portion of the developer gets stuck between the developing sleeve and the photosensitive drum. If developing is forcibly performed with the portion of the developer being stuck, various problems could occur. For example, the carrier might adhere to the photosensitive drum or a recording sheet, or the developer might be scattered in the device and adhere to other components of the device.

However, if the minimum distance DS between the developing sleeve and the photosensitive drum is increased to prevent the developer from getting stuck, it will be necessary to increase the electric field intensity between the developing sleeve and the photosensitive drum by increasing the bias voltage for development applied to the developing sleeve, in order to cause electrostatic attraction of charged toner to the photosensitive drum. This increases the edge effect of the electric field, and causes an image formation failure. FIG. 27 is a conceptual diagram illustrating the edge effect. As shown in FIG. 27, if the electric field intensity is increased when the minimum distance DS is large, the toner will be supplied to the edge of the electrostatic latent image from a larger area of the developing sleeve. Consequently, an image formation failure occurs, that is, the concentration of the toner in the edge becomes too high (FIG. 27B).

As a solution to this problem, there has been known a technology of adjusting the amount of developer transported by the developing sleeve by controlling the positional relationship between a restriction member, which restricts the amount of developer transported by the developing sleeve, and a magnet roll, which is inserted in the developing sleeve, according to the T/C ratio of the developer detected by a magnetic permeability sensor, for example (See Japanese Patent Application Publication No. 10-31366, for example). There has also been known a technology of controlling the amount of transportation of developer by controlling the distance between the restriction member and the developing sleeve according to the T/C ratio detected in a similar manner (See Japanese Patent Application Publication No. 09-222792, for example). With such optimization of the transportation amount of developer, it is possible to prevent the developer from getting stuck without increasing the minimum distance DS between the developing sleeve and the photosensitive drum, and thereby prevent problems such as image formation failures.

However, the use of a magnetic permeability sensor for detecting the T/C ratio is undesirable, because it increases the component cost and manufacturing cost of the developing device, contrary to demands for cost reduction of developing devices and image forming apparatuses. In addition, it will be necessary to provide a mechanism for controlling the distance between the developing sleeve, or the magnet roll inserted in the developing sleeve, and the restriction member. In terms of such a necessity, the use of a magnetic permeability sensor inevitably increases the cost.

SUMMARY OF THE INVENTION

The present invention is made in view of the problem described above, and aims to provide a low-cost developing device and a low-cost image forming apparatus that are capable of reducing the change in the amount of transportation of developer caused by the change in T/C ratio.

To achieve the aim described above, the present invention provides a developing device for developing an electrostatic latent image on an image carrier by using two-component developer containing toner and magnetic carrier, comprising: a magnetic member having a plurality of magnetic poles along a circumferential direction of the magnetic member; a developing sleeve in which the magnetic member is inserted, transporting developer to a developing area facing the image carrier; and a restriction member made of magnetic material, disposed along a rotational axis of the developing sleeve so as to face an outer circumferential surface of the developing sleeve, and restricting the amount of developer to be transported to the developing area to be no greater than 250 g/m$^2$, wherein the magnetic member generates magnetic flux such that an average of absolute values of magnetic flux density within a restriction area falls within a range of 40 mT to 70 mT under a condition that no developer exists within the restriction area, the restriction area extending along the outer circumferential surface between a closest point on the outer circumferential surface, which is closest to the restriction member, and a point 2 mm upstream from the closest point in a rotational direction of the developing sleeve, and having a height that is half a minimum distance between the closest point and the restriction member.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings:

FIG. 10 is a table for comparing a practical example and a comparative example in terms of the occurrence of carrier adhesion and a lead off at different T/C ratios;

FIG. 13 is a table showing experimental values of the average density $|B_m|$, the occurrence frequency of the carrier adhesion and the change ratio in the amount of transportation of developer for each combination of the outer diameter of the developing sleeve 211, the shape of the restriction member 220, the particle size of the magnetic carrier and the Mg magnetic force restriction position;

FIG. 14 shows experimental conditions A-1 through A-3 with respect to "Mg magnetic force/restriction position";

DESCRIPTION OF PREFERRED EMBODIMENTS

The following describes embodiments of a developing device and an image forming apparatus pertaining to the present invention, with reference to the drawings.

[1] Structure of Image Forming Apparatus

First of all, the structure of the image forming apparatus according to an embodiment is described.

Figure 1:
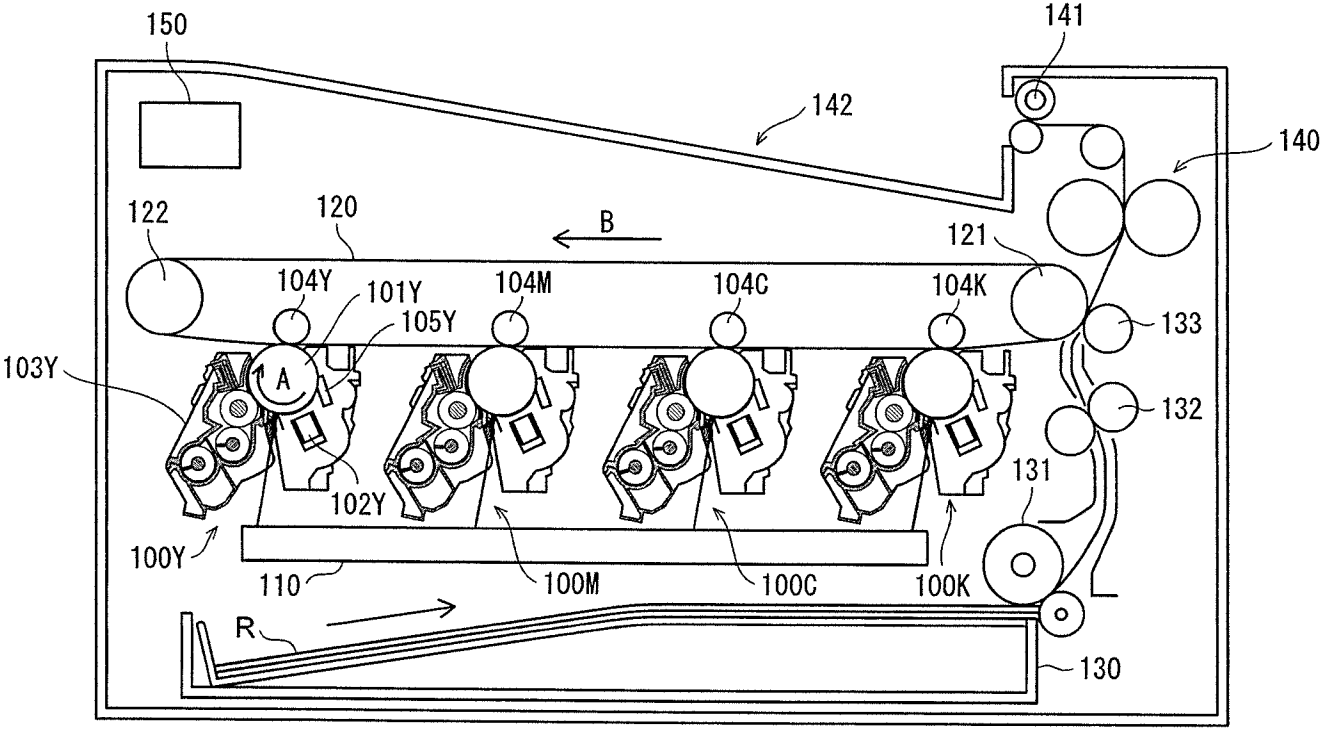
FIG. 1 shows the structure of an image forming apparatus pertaining to an embodiment of the present invention.

As shown in FIG. 1, an image forming apparatus 1 pertaining to the present invention is a tandem color printer, and includes image creators 100Y through 100K, an exposure device 110, an intermediate transfer belt 120, a paper feeder 130, a fixing device 140 and a control device 150. The image forming apparatus 1 is connected to, for example, a local area network (LAN). Upon receiving an instruction to execute a print job from an external device (not depicted in the drawing) such as a personal computer (PC), the image forming apparatus 1 creates toner images of yellow (Y), magenta (M), cyan (C) and black (K) colors, and sequentially transfers the toner images to form a full-color image.

Since the image creators 100Y through 100K have a same structure, they are collectively described below without identifying their colors.

Each image creator 100 has a photosensitive drum 101 rotated by a drive source (not depicted in the drawing) in a direction indicated by the arrow A. Around the photosensitive drum 101, a charging device 102, an exposure device 110, a developing device 103, a primary transfer roller 104 and a cleaning device 105 are arranged in this order along the direction indicated by the arrow A. The charging device 102 uniformly charges the outer circumferential surface of the photosensitive drum 101. The exposure device 110 has an LED array in which many light emitting diodes (LEDs) are arranged in a line. Under the control of the control device 150, the exposure device 110 performs expose-scanning on the uniformly-charged outer circumferential surface of the photosensitive drum 101 with a laser beam emitted by the LED array, and thus forms an electrostatic latent image.

The developing device 103 is supplied with developer from a toner cartridge (not depicted in the drawing), and visualizes the electrostatic latent image and forms a toner image by providing toner to the outer circumferential surface of the photosensitive drum 101. The toner is charged, and is electrostatically attracted to the outer circumferential surface of the photosensitive drum 101 due to the bias voltage for development applied between the photosensitive drum 101 and the developing device 103.

The primary transfer roller 104 and the photosensitive drum 101 hold an intermediate transfer belt 120 between them. A primary transfer bias voltage, which is a DC voltage, is applied between the primary transfer roller 104 and the photosensitive drum 101. Due to the bias voltage, the toner image carried on the outer circumferential surface of the photosensitive drum 101 is electrostatically transferred (primary transfer) onto the intermediate transfer belt 120.

The cleaning device 105 cleans up and collects remaining toner on the outer circumferential surface of the photosensitive drum 101 after the primary transfer.

Each of the image creators 100Y through 100K operates as described above, and achieves primary transfer of toner images of Y, M, C and K colors onto to the intermediate transfer belt 120.

The intermediate transfer belt 120 is an endless belt, and is suspended with tension between a drive roller 121 and a passive roller 122, and is caused to move cyclically by a drive source (not depicted in the drawing). The intermediate transfer belt 120 cyclically runs in the direction indicated by the arrow B. While the intermediate transfer belt 120 is running, the toner images of Y through K colors created by the image creators 100Y through 100K are overlaid on the intermediate transfer belt 120 by primary transfer. Thus, the intermediate transfer belt 120 transfers the toner images to a secondary transfer nip.

The paper feeder 130 houses recording sheets R. A pickup roller 131 picks up one of the recording sheets R at a time from the paper feeder 130, and feeds the recording sheet onto a transport path. The recording sheet R thus picked up is transported to the secondary transfer nip after timing adjustment by a pair of timing rollers 132, and then the toner images are transferred to the recording sheet R (secondary transfer).

The secondary transfer roller 133 is pressed against the drive roller 121, and thereby forms the secondary transfer nip. A secondary transfer bias voltage, which is a DC voltage, is applied between the drive roller 121 and the secondary transfer roller 133. At the secondary transfer nip, the toner images carried by the intermediate transfer belt 120 are electrostatically transferred (secondary transfer) from the intermediate transfer belt 120 to the recording sheet R due to electrostatic attraction caused by the secondary transfer bias voltage.

The toner images on the recording sheet R is thermally fixed by the fixing device 140, and the recording sheet R is ejected onto a catch tray 142 by an ejection roller 141.

[2] Structure of Developing Device 103

Next, the structure of the developing device 103 is described. As described above, the developing devices 103Y through 103K have a same structure, and they are simply referred to as "the developing device 103" in the following description.

The developing device 103 uses two-component developer containing toner and magnetic carrier. The magnetic carrier used in the present embodiment consists of ferrite core materials coated with resin. The average size of the particles is 30 μm, and the magnetization strength (σ1000) is 42 emu/g. Here, the term "magnetization strength (σ1000)" means the strength of magnetization induced by an external 1000 G magnetic field. The toner consists of polyester polymer particles having an average particle size of 6 μm.

Figure 2:
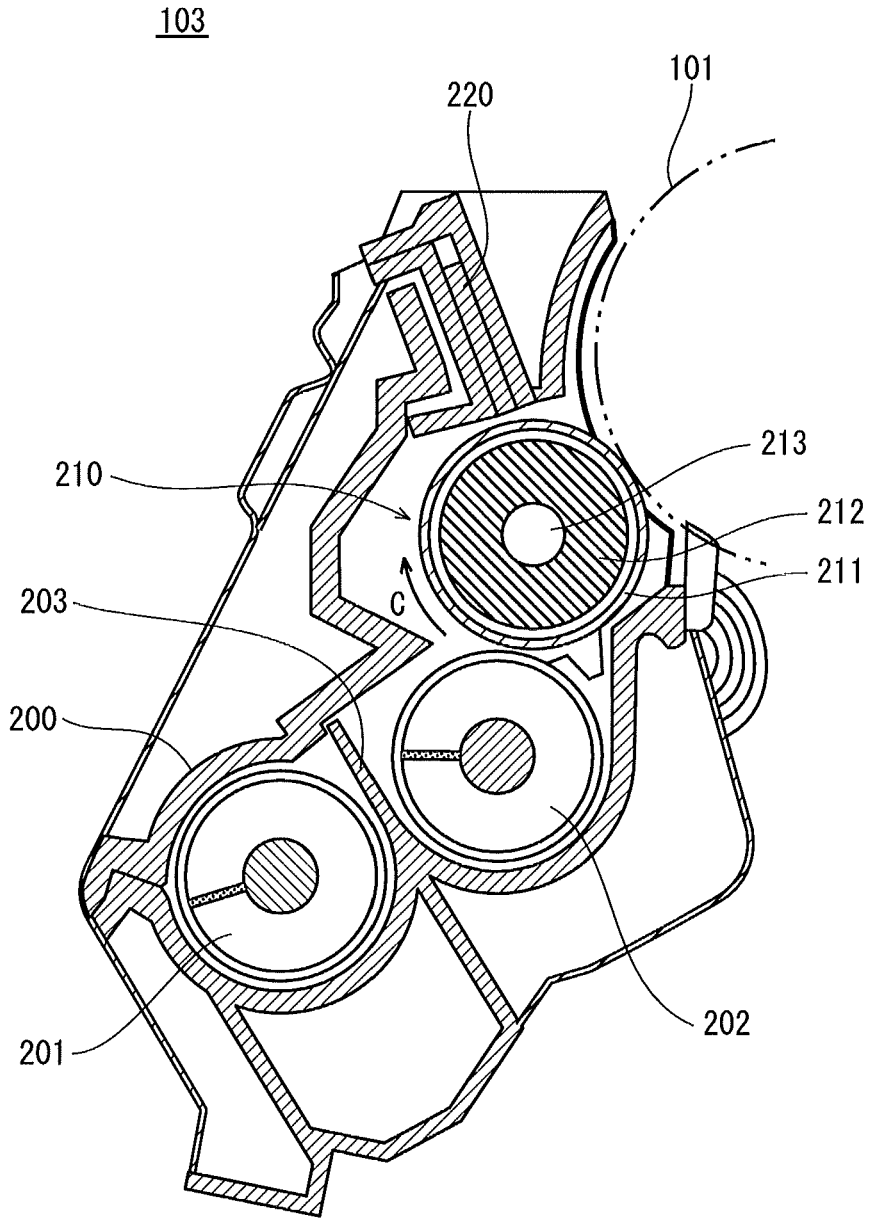
FIG. 2 is a cross-sectional view showing the structure of a developing device 103.

As shown in FIG. 2, the developing device 103 has a stirrer screw 201, a feed screw 202, a developing roller 210 and a restriction member 220, which are arranged within a housing 220 serving as a developer tank.

The stirrer screw 201 and the feed screw 202 are arranged such that their rotational axes are in parallel. Also, they are separated by a partition 203. The stirrer screw 201 and the feed screw 202 transport the developer in opposite directions, so that the developer is circulated within the housing 200. Consequently, the developer is prevented from being solidified and is kept flowable. Also, the toner contained in the developer is charged by friction. The feed screw 202 is arranged such that the rotational axis thereof is in parallel with the rotation shaft of the developing roller 210 as well. With this arrangement, the feed screw 202 supplies the developing roller 210 with the developer.

The developing roller 210 is composed of a developing sleeve 211, which is cylindrical, and a magnet roller 212 inserted in the developing sleeve 211 along the roller axis direction.

The developing sleeve 211 is an aluminum sleeve having an inside diameter of 15 mm and an outside diameter of 16 mm. The outer circumferential surface of the developing sleeve 211 has undergone a blasting process. The developing sleeve 211 is made of aluminum or other non-magnetic material.

The developing sleeve 211 is arranged to face the photosensitive drum 101 with the minimum distance DS between them, and their rotational axes are parallel. The developing sleeve 211 is rotated in the direction indicated by the arrow C, with the bias voltage for development being applied between the developing sleeve 211 and the photosensitive drum 101. Due to the bias voltage, the toner on the outer circumferential surface of the developing sleeve 211 is electrostatically attracted to the electrostatic latent image on the photosensitive drum 101.

The magnet roller 212 consists of a plurality of magnet pieces fixed to the outer circumferential surface of a shaft 213 having a columnar shape. The outside diameter of the magnet roller 212 is 14 mm. Note that both ends of the shaft 213 of the magnet roller 212 are fixed to the housing 200 so that the magnet roller 212 does not rotate.

Figure 3:
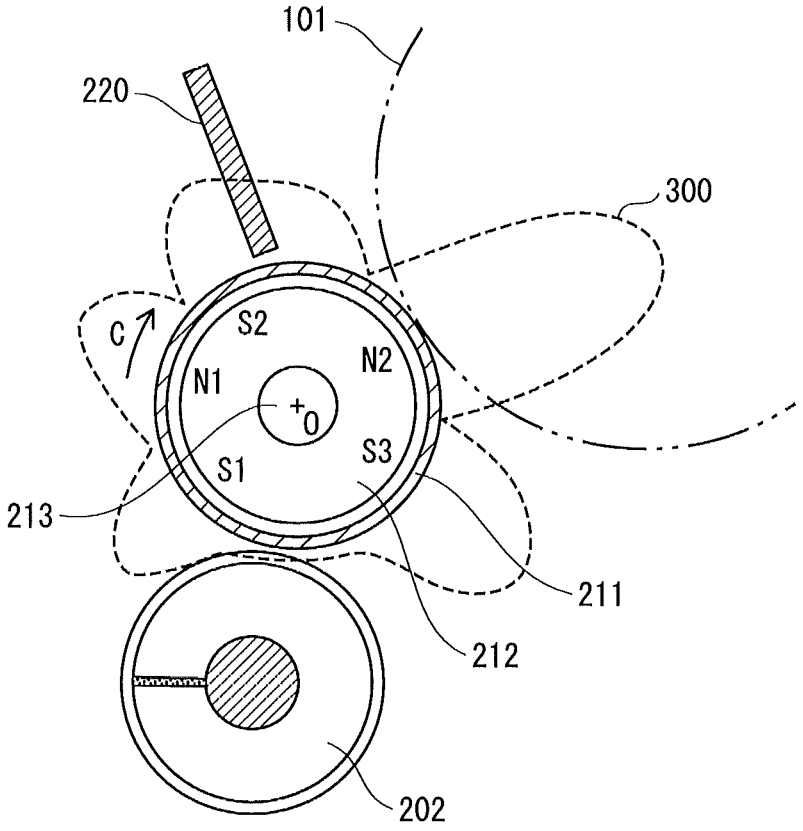
FIG. 3 is a cross-sectional view showing the structure of a magnet roller 212.

As shown in FIG. 3, the magnet roller 212 has five magnetic poles, namely a catch pole S1, a transport pole N1, a restriction pole S2, a developing pole N2 and a releasing pole S3. In FIG. 3, the dashed line 300 is a graph representing the magnitude (absolute value) of the magnetic flux density on the outer circumferential surface of the developing sleeve 211. That is, the magnitude of the magnetic flux density at each point on the outer circumferential surface of the developing sleeve 211 is represented by the length from the point to the intersection point of the dashed line 300 with the half-line (not depicted in the drawing) connecting the rotation center O of the developing sleeve 211 and the point.

The catch pole S1 attracts developer onto the outer circumferential surface of the developing sleeve 211 by attracting the magnetic carrier contained in the developer provided by the feed screw 202. Since the outer circumferential surface of the developing sleeve 211 has fine concavities and convexities resulting from the blasting process, the outer circumferential surface generates friction with the developer. Therefore, the developer is transported as the developing sleeve 211 rotates in the direction indicated by the arrow C.

The transport pole N1 has an opposite polarity to the catch pole S1. Therefore, the magnetic force line occurs between the transport pole N1 and the catch pole S1. The magnetic carrier is attracted along this magnetic force line, and thus the developer is smoothly transported from the catch pole S1 to the transport pole N1. The transport pole N1 and the restriction pole S2 have opposite polarities as well. Therefore, the developer is smoothly transported from the transport pole N1 to the restriction pole S2.

The restriction member 220 is located downstream from the restriction pole S2 with respect to the rotational direction of the developing sleeve 211, with a predetermined distance from the developing sleeve 211. The restriction member 220 is blade-like, and its closest point to the developing sleeve 211 is 1.5 mm downstream from the peak point of the restriction pole S2. The restriction member 220 restricts the amount of developer transported by the developing sleeve 211 to the developing area to be not greater than 250 g/m$^2$. The height of the developer accumulated on the developing sleeve 211 is restricted by being in contact with the restriction member 220.

Note that the height of the developer is measured from the outer circumferential surface of the developing sleeve 211. Due to this height restriction, the amount of toner supplied to the photosensitive drum 101 is restricted. The restriction member 220 is made from a magnetic plate of stainless used steel (SUS 430) having a thickness of 1.6 mm (on the assumption that the relative magnetic permeability is 1000). In the present embodiment, the distance Db between the restriction member 220 and the developing sleeve 211 is 470 μm.

At the developing pole N2, the height of the developer is large and a so-called magnetic brush is formed, because the magnetic flux density is particularly high at the developing pole N2. Since the developing bias voltage is applied to the developing sleeve 211, the toner contained in the magnetic brush is electrostatically attracted toward the photosensitive drum 101, and thus the electrostatic latent image is developed.

The releasing pole S3 has the opposite polarity to the developing pole N2, and therefore the developer is smoothly transported from the developing pole N2 to the releasing pole S3. On the other hand, the releasing pole S3 and the catch pole S1 have the same polarity and are distant from each other, the developer falls down from the developing sleeve 211 due to the gravity while being transported from the releasing pole S3 to the catch pole S1. The developer thus fell down is stirred and transported by the feed screw 202 and the stirrer screw 201 again.

[3] Control of Amount of Transportation of Developer

Next, a description is given to the control of the amount of transportation of the developer, which is an aim of the present invention.

(3-1) Relationship Between Amount of Transportation of Developer and Magnetic Force of Restriction Pole S2

The amount of developer transported by the developing sleeve 211 rotating is controlled by the magnitude of the magnetic flux generated by the restriction pole S2, as well as the distance Db between the restriction member 220 and the developing sleeve 211.

That is, the normal force is generated between the developer and the developing sleeve 211 by the magnetic carrier being attracted to the restriction pole S2. Due to the friction generated between the developer and the developing sleeve 211 by the normal force, the developer is transported according to the rotation of the developing sleeve 211. Therefore, the amount of the transportation of the developer increases as the magnetic force of the restriction pole S2 increases, and the amount of the transportation of the developer decreases as the magnetic force of the restriction pole S2 decreases.

Figure 4:
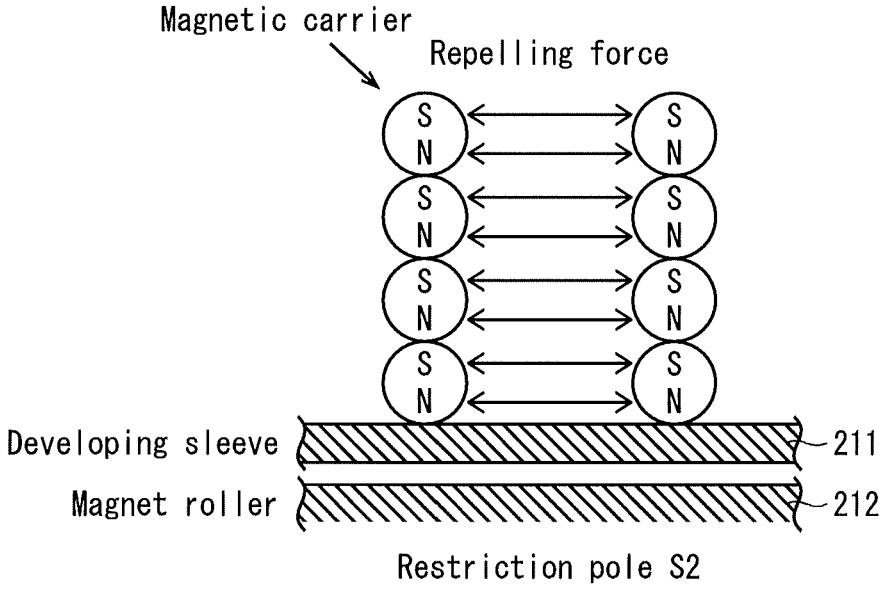
FIG. 4 is a cross-sectional view showing part of a developing sleeve 211.

Also, when the T/C ratio is low and the amount of carrier in the developer is large, the mutual effect between the particles of the magnetic carrier is large. As shown in FIG. 4, the particles of the magnetic carrier of the developer transported to the restriction pole S2 are magnetized and form magnetic chains. Since the particles of the magnetic carrier have an almost same size, pairs of particles having a same polarity repel each other, and hence the magnetic chains repel each other.

Figure 5:
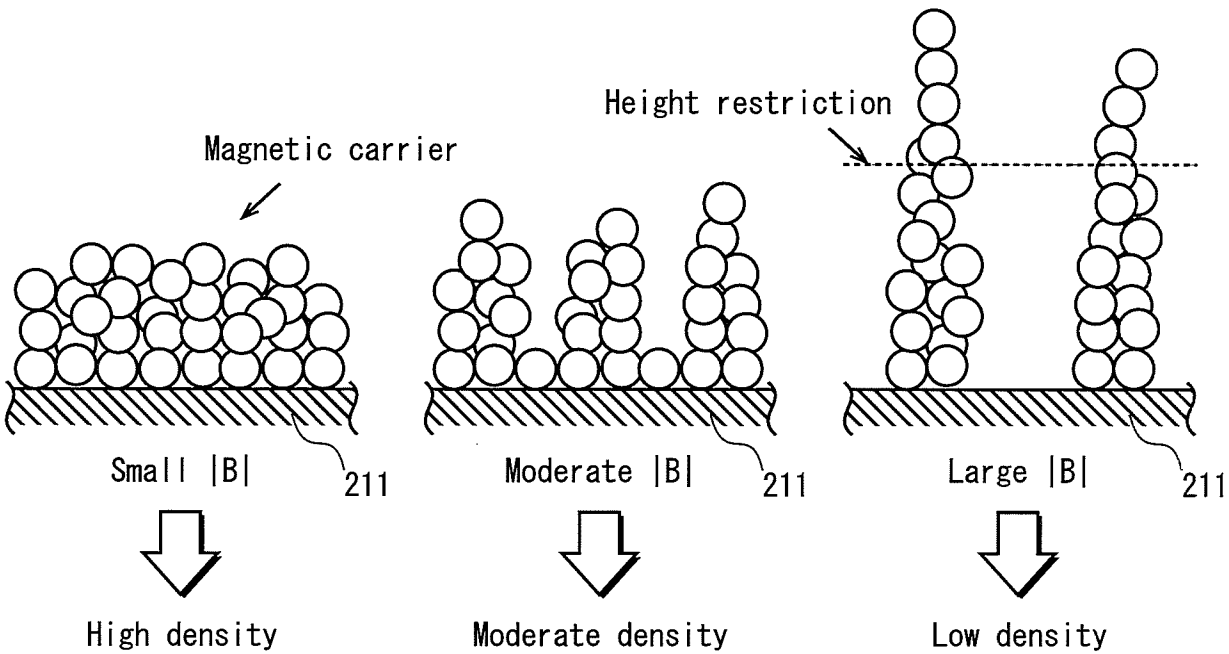
FIG. 5 shows a relationship between a magnetic force of a restriction pole S2 and a magnetic chain.

As shown in FIG. 5, when the magnetic force of the restriction pole S2 is weak, the repelling force between the magnetic chains is small, because the degree of magnetization of the particles of the magnetic carrier is not very high. Therefore, the density of the developer will be high. In contrast, when the magnetic force of the restriction pole S2 is strong, the repelling force between the magnetic chains is large, because the degree of magnetization of the magnetic carries is high. Therefore, the density of the developer will be low. In particular, when the magnetic force of the restriction pole S2 is strong and the lengths of the magnetic chains exceed the minimum distance Db from the outer circumferential surface of the developing sleeve 211 to the restriction member 220, the amount of the developer is also decreased by the restriction member 220 restricting the heights of the magnetic chains.

When the T/C ratio is high, the amount of the carrier in the developer is small and hence the magnetic force of the developer is low, the repelling force between the magnetic chains is small. Therefore, when the T/C ratio is high, the friction between the developer and the developing sleeve 211, which is determined by the magnetic force of the restriction pole S2, dominantly determines the amount of the transportation of the developer.

Figure 6:
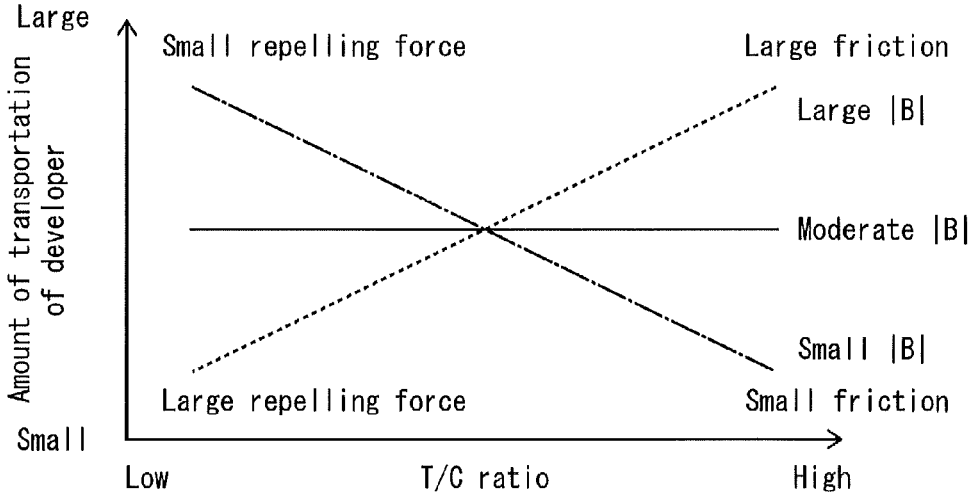
FIG. 6 is a graph illustrating a relationship between the T/C ratio and the amount of transportation of developer, which changes according to the magnetic force of the restriction pole S2.

In summary, as shown in FIG. 6, when the magnetic force of the restriction pole S2 is strong, the amount of the transportation of the developer decreases as the T/C ratio decreases because the repelling force between the magnetic chains increases as the T/C ration decreases, and the amount of the transportation of the developer increases as the T/C ration increases because the friction between the developer and the developing sleeve 211 increases as the T/C ratio increases.

On the other hand, when the magnetic force of the restriction pole S2 is weak, the amount of the transportation of the developer increases as the T/C ratio decreases, because the repelling force between the magnetic chains does not increase as the T/C ratio decreases, and the friction due to the large amount of magnetic carrier contained in the developer increases and have a large influence. Furthermore, when the T/C ratio increases, the amount of the magnetic carrier contained in the developer decreases, and the friction between the developer and the developing sleeve 211 decreases. Accordingly, the amount of the transportation of the developer decreases.

Therefore, it is expected that the amount of the transportation of the developer can be maintained at a fixed level independent from the T/C ratio by setting the magnetic force of the restriction pole S2 within an appropriate range.

Figure 7:
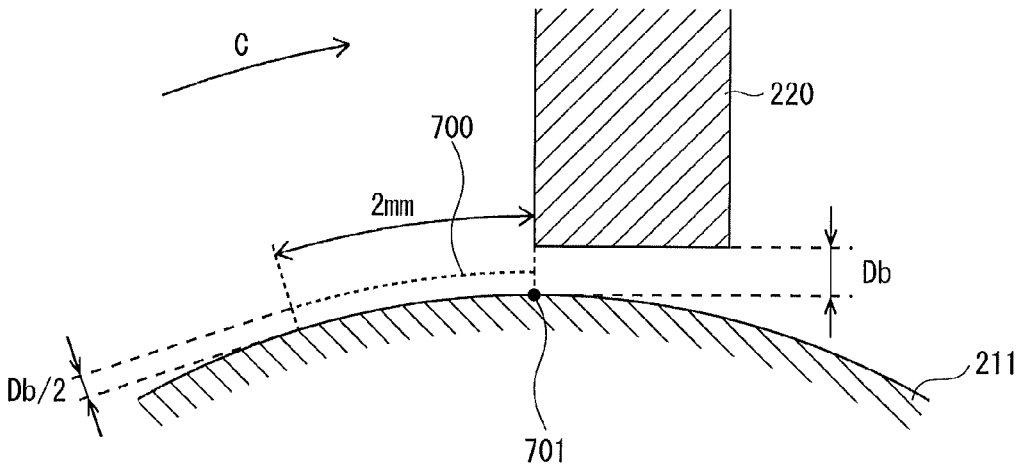
FIG. 7 is a cross-sectional view showing the range of a restriction area.

For the control of the amount of the transportation of the developer, it is effective to evaluate the magnetic force of the restriction pole S2 by using the average of the absolute value |B| of the magnetic flux density (hereinafter referred to as "average density $|B_m|$") within the space (hereinafter referred to as "restriction area") described below. FIG. 7 is a cross-sectional view taken along a plane perpendicular to the rotational axis of the developing sleeve 211. As shown in FIG. 7, the restriction area 700 is ranged from the closest point 701, which is the closest point to the restriction member 220 on the outer circumferential surface of the developing sleeve 211, to the point that is 2 mm upstream from the closest point 701 in the rotational direction (indicated by the arrow C) of the developing sleeve 211, and the height of the restriction area is Db/2 from the outer circumferential surface of the developing sleeve 211. Here, the height Db equals to the minimum distance between the developing sleeve 211 and the restriction member 220.

(3-2) Average Density $|B_m|$ Pertaining to Present Embodiment

The average density within the restriction area 700 is obtained by measuring the magnetic flux density Br at the height of 100 μm from the outer circumferential surface of the developing sleeve 211 along the circumferential direction of the developing sleeve 211 under the condition that the restriction member 220 is absent.

Figure 8:
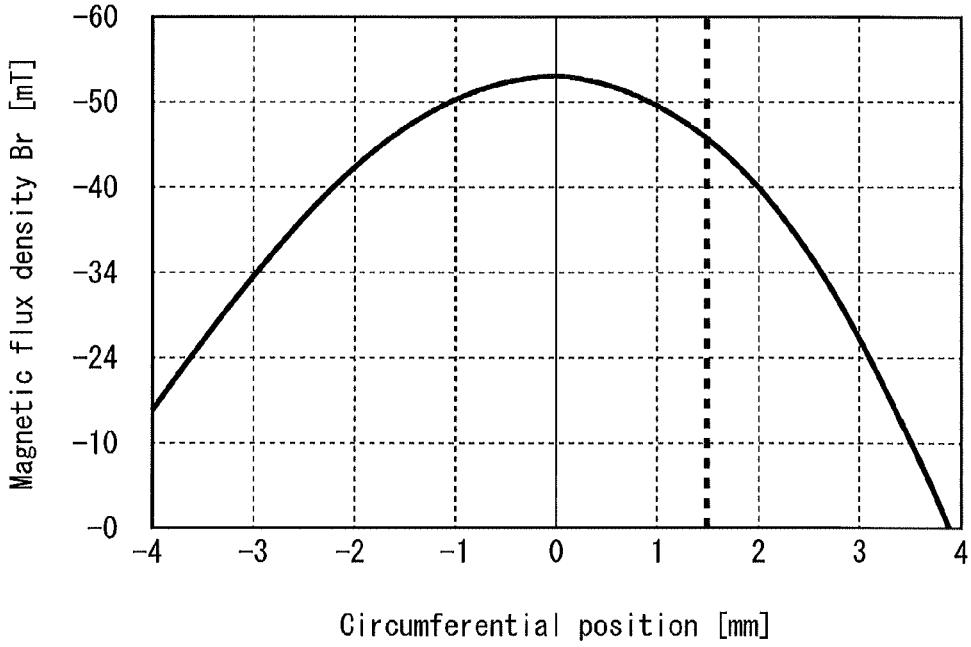
FIG. 8 is a graph showing measurement values of magnetic flux density Br near the restriction pole S2.

FIG. 8 shows the measurement values of the magnetic flux density Br in the vicinity of the restriction pole S2. In FIG. 8, the vertical axis indicates the magnetic flux density and the horizontal axis shows the position in the circumferential direction. Note that the circumferential position of the peak point of the restriction pole S2 is represented as 0. The dashed line represents the closest point to the restriction member 220. The average density $|B_m|$ obtained from these measurement values is 62 mT.

(3-3) Comparative Example

The following is a study of the effect of the developing device 103 pertaining to the present embodiment in comparison with a comparative example.

The developing device pertaining to the comparative example is a conventional developing device, and has the same structure as the developing device 103 except for the magnetic force of the restriction pole S2 and the position of the restriction member 220.

Figure 9:
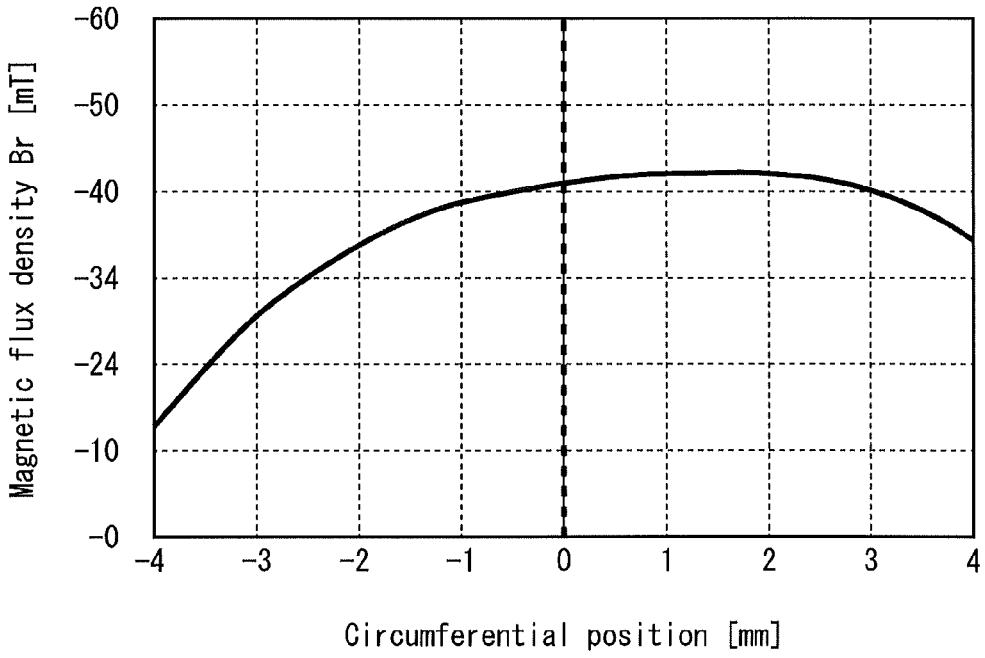
FIG. 9 is a graph showing measurement values of magnetic flux density Br near the restriction pole S2.
Figure 11A:
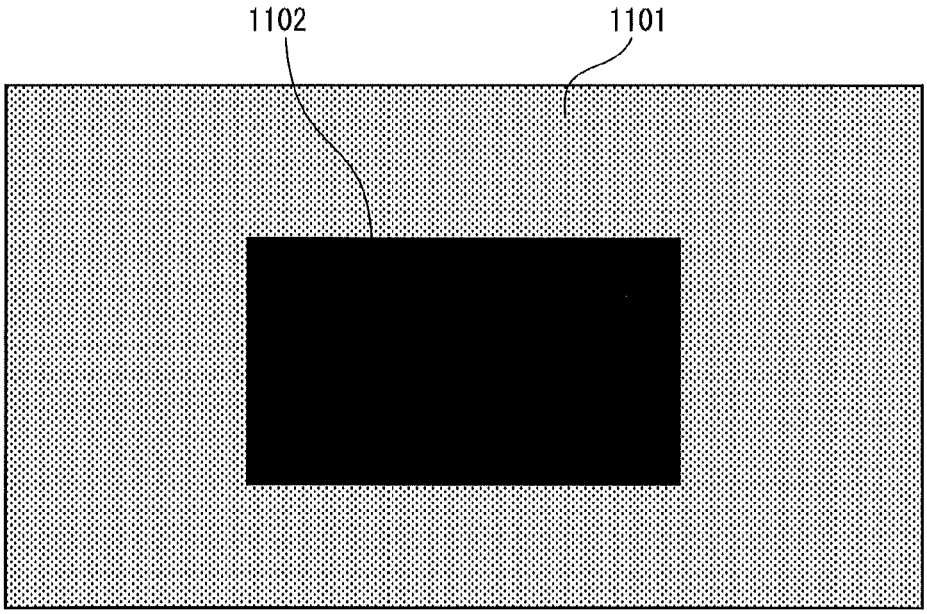
FIG. 11A shows an image without a lead off.
Figure 11B:
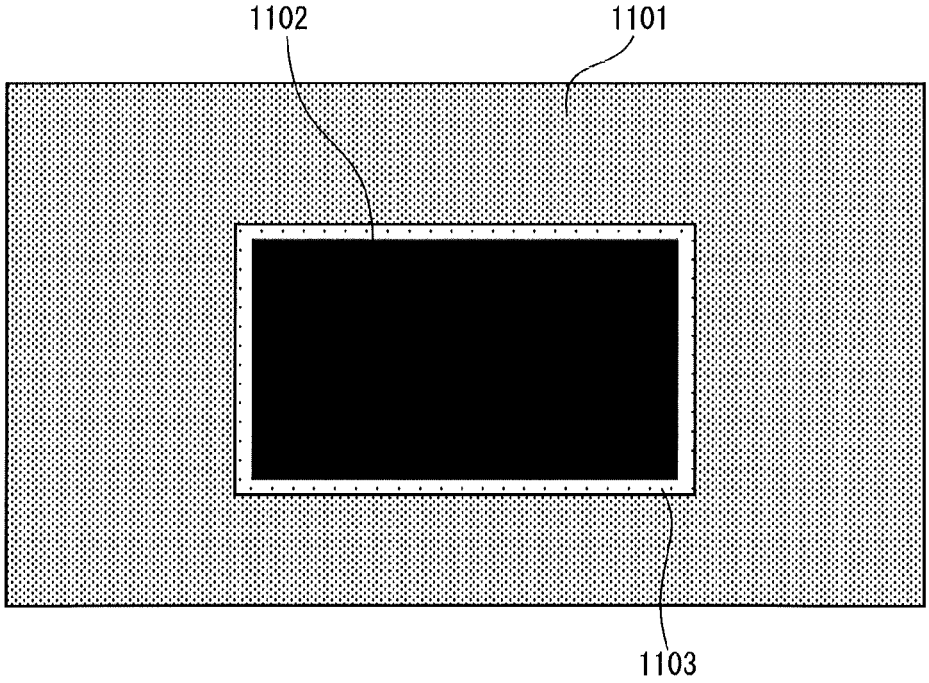
FIG. 11B shows an image with a lead off.

FIG. 9 shows the measurement values of the magnetic flux density Br in the vicinity of the restriction pole S2 pertaining to the comparative example. In FIG. 9, the vertical axis indicates the magnetic flux density and the horizontal axis shows the position in the circumferential direction. Note that the circumferential position of the peak point of the restriction pole S2 is represented as 0. The dashed line represents the closest position to the restriction member 220, and coincides with the peak point of the restriction pole S2. The magnetic flux density was measured under that condition that the restriction member 220 was absent. The average density $|B_m|$ of the comparative example is 30 mT.

With respect to the developing device 103 and the comparative example, adhesion of the carrier to the photosensitive drum 101 and to the recording sheet and the occurrence of a "lead off" phenomenon were observed with the T/C ratio changed from 1% to 9% in increments of 1%. Practically, the T/C ratio does not exceed 10%. This is for the following reason. When the T/C ratio is equal to or greater than 10%, the surface area of the toner relative to the surface area of the carrier is too large, and even after the developer is stirred sufficiently, some particles of toner are not charged and causes a problem due to insufficient charge (e.g. developer scatters in the device).

Therefore, evaluation within the range where the T/C ratio is 9% or less suffices the purpose.

The photosensitive drum 101 was set to have an outside diameter of 30 mm, and the developing sleeve 211 and the photosensitive drum 101 were rotated in the same direction when viewed along their rotational axes such that the ratio θ of their circumferential velocities become 2.0. The minimum distance DS between the developing sleeve 211 and the photosensitive drum 101 was set to 300 μm. The voltage used as the bias voltage for development was generated by superimposing an AC rectangular component having an amplitude of 1500 V and a frequency of 4 kHz onto a DC component adjusted to achieve a desirable developing density. The circumferential velocity of the photosensitive drum 101 was set to 50 minis or 150 mm/s. However, no difference was made by the difference in circumferential velocity of the photosensitive drum 101.

FIG. 10 shows the results of the experiments. As shown in FIG. 10, in the developing device 103 pertaining to the present embodiment, no carrier adhesion was observed at every T/C ratio from 1% to 9%. A lead off phenomenon that is not practically significant was observed when the T/C ratio fell within the range of 1% to 2%. However, no lead off phenomenon was observed when the T/C ratio is 3% or greater.

In contrast, in the comparative example, the carrier adhesion was observed when the T/C ratio fell within the range of 1% to 3%. Also, a lead off phenomenon that is not practically significant was observed when the T/C ratio was 1% or 8%, and a lead off phenomenon that is practically unacceptable was observed when the T/C ratio was 9%.

Note that a "lead off" phenomenon is a problem that, when a high-density image 1102 is formed inside an intermediate tone image 1101, the density of the peripheral area 1103 of the high-density image 1102 will be lower than the density of the intermediate tone image 1101.

Figure 12:
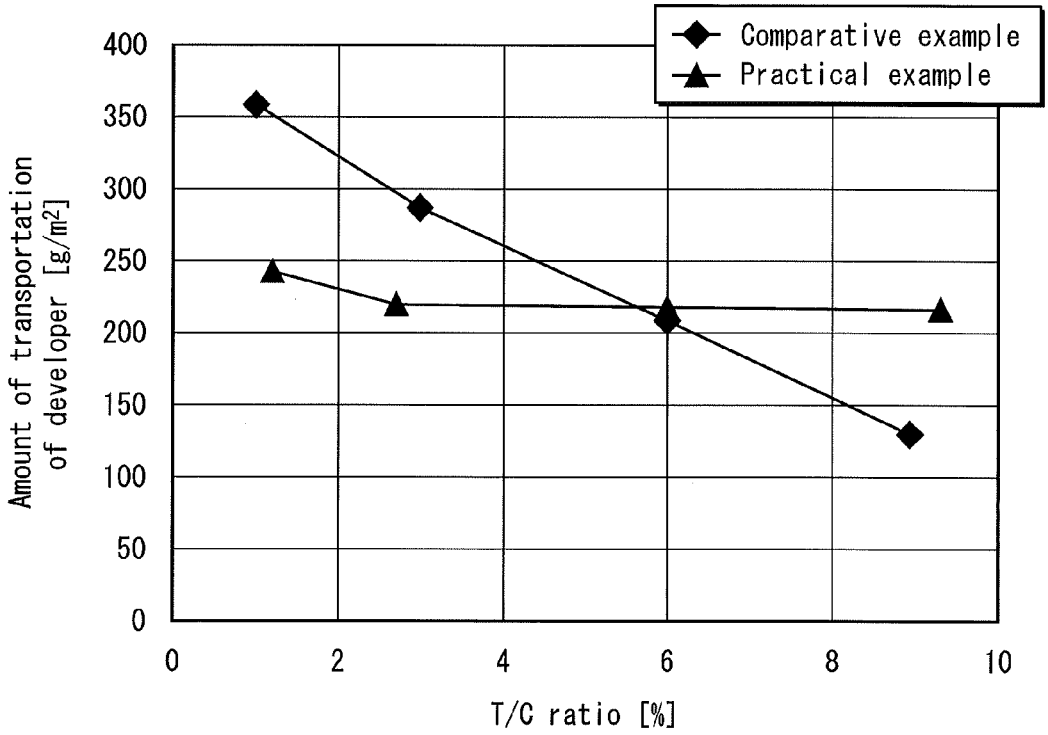
FIG. 12 is a graph showing the change in the amount of transportation of developer according to the T/C ratio for each of the practical example and the comparative example.
Figure 15:
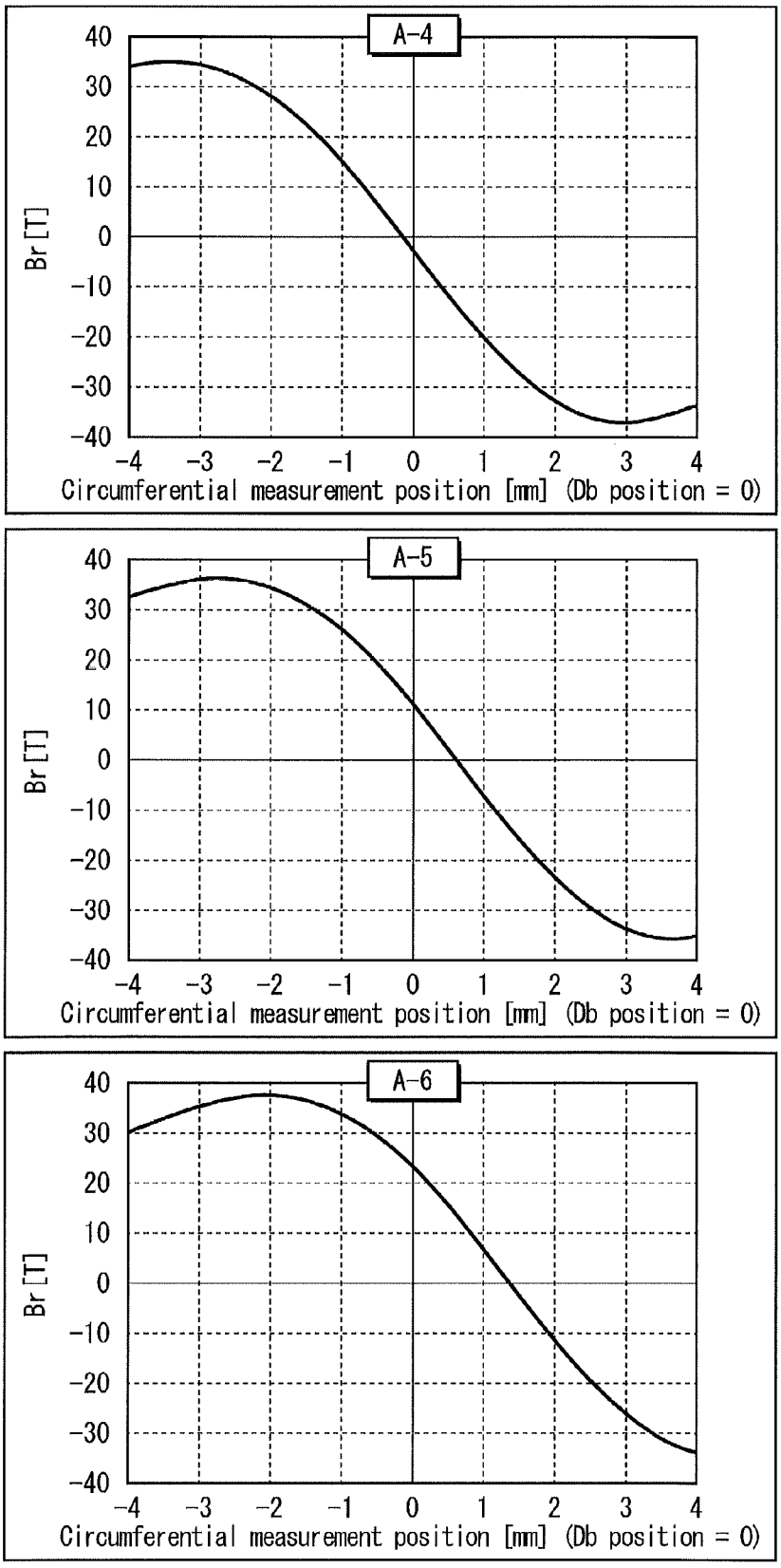
FIG. 15 shows experimental conditions A-4 through A-6 with respect to "Mg magnetic force/restriction position"
Figure 16:
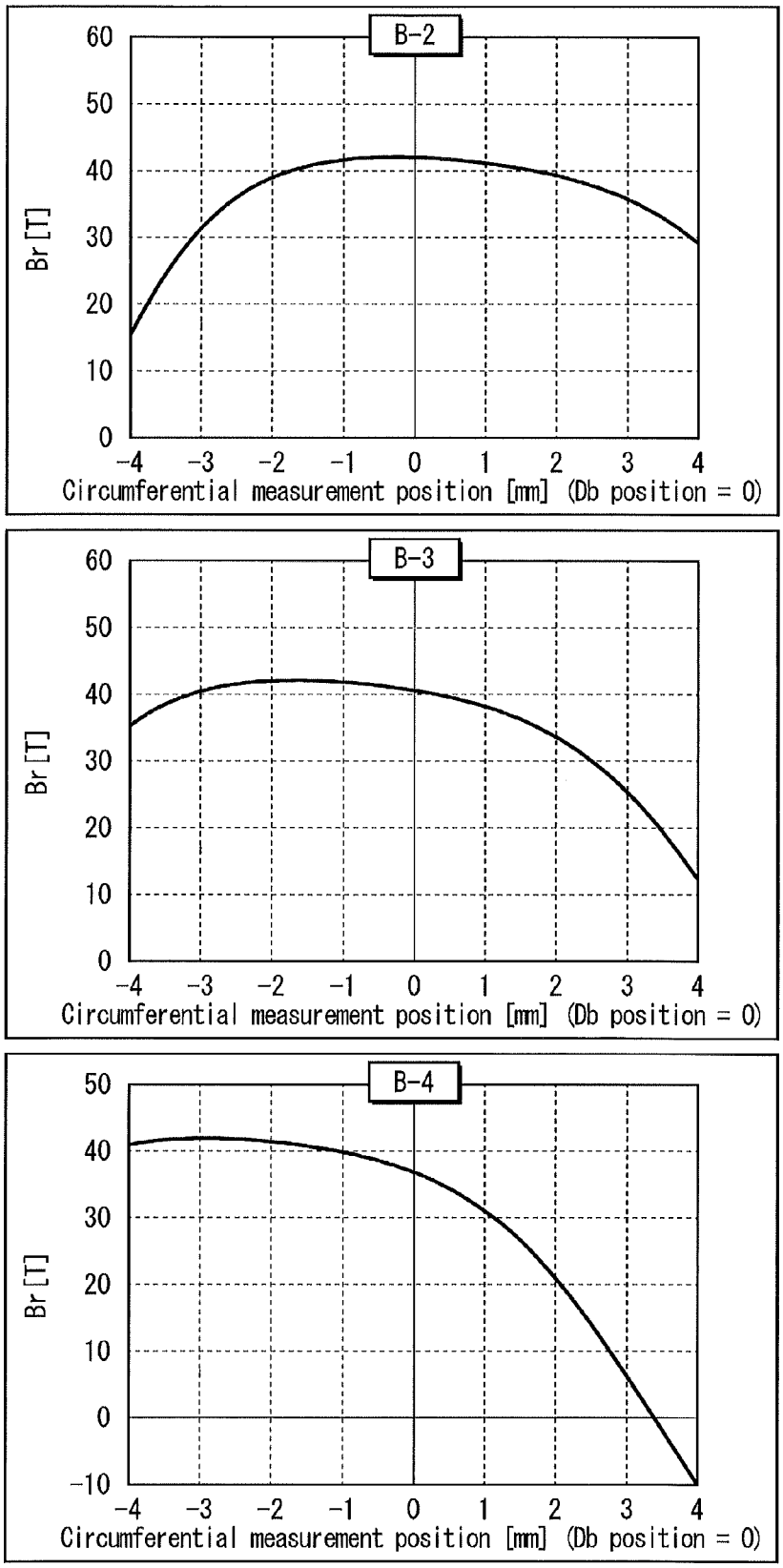
FIG. 16 shows experimental conditions B-2 through B-4 with respect to "Mg magnetic force/restriction position"
Figure 17:
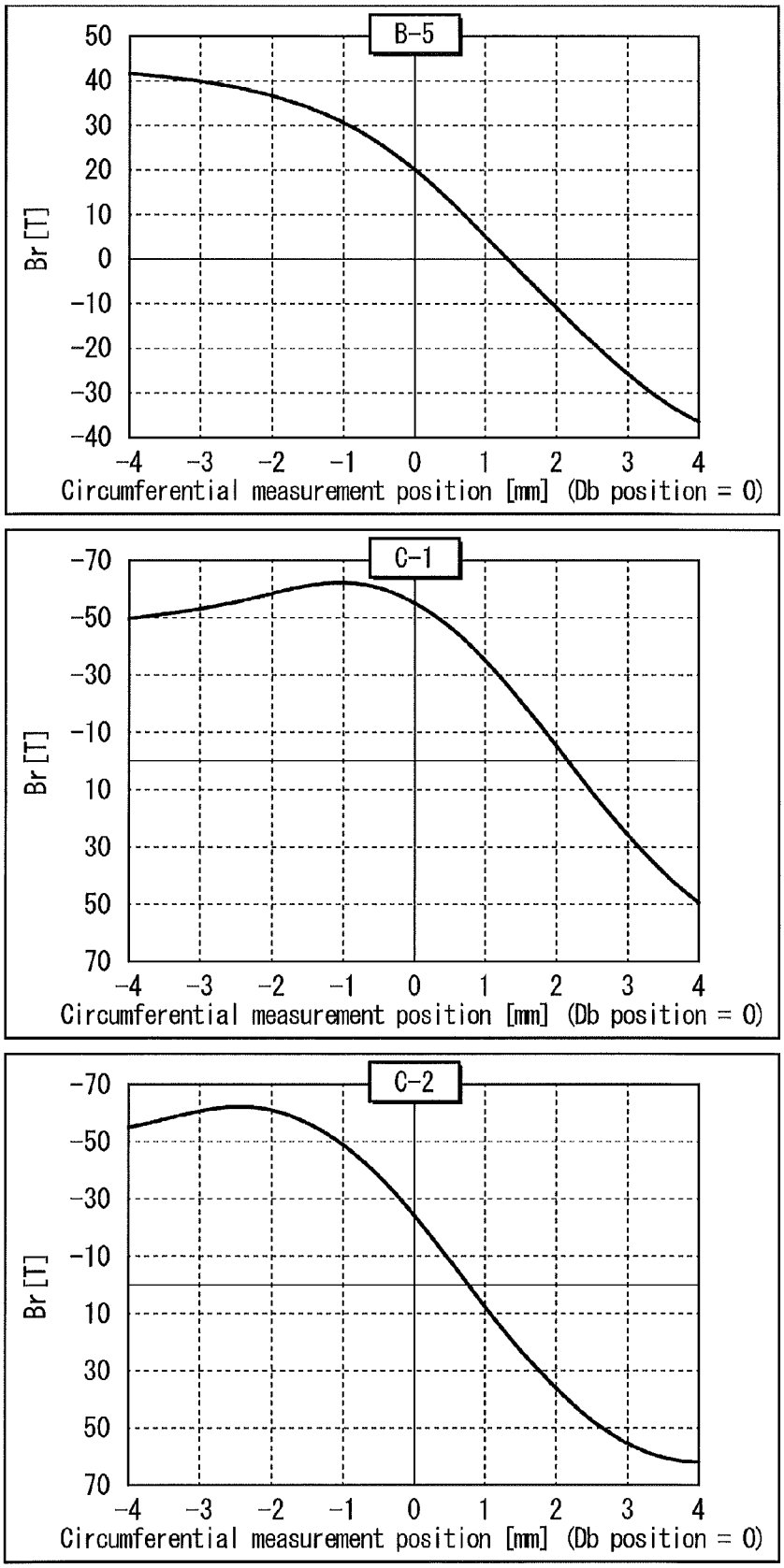
FIG. 17 shows experimental conditions B-5 through C-2 with respect to "Mg magnetic force/restriction position"
Figure 18:
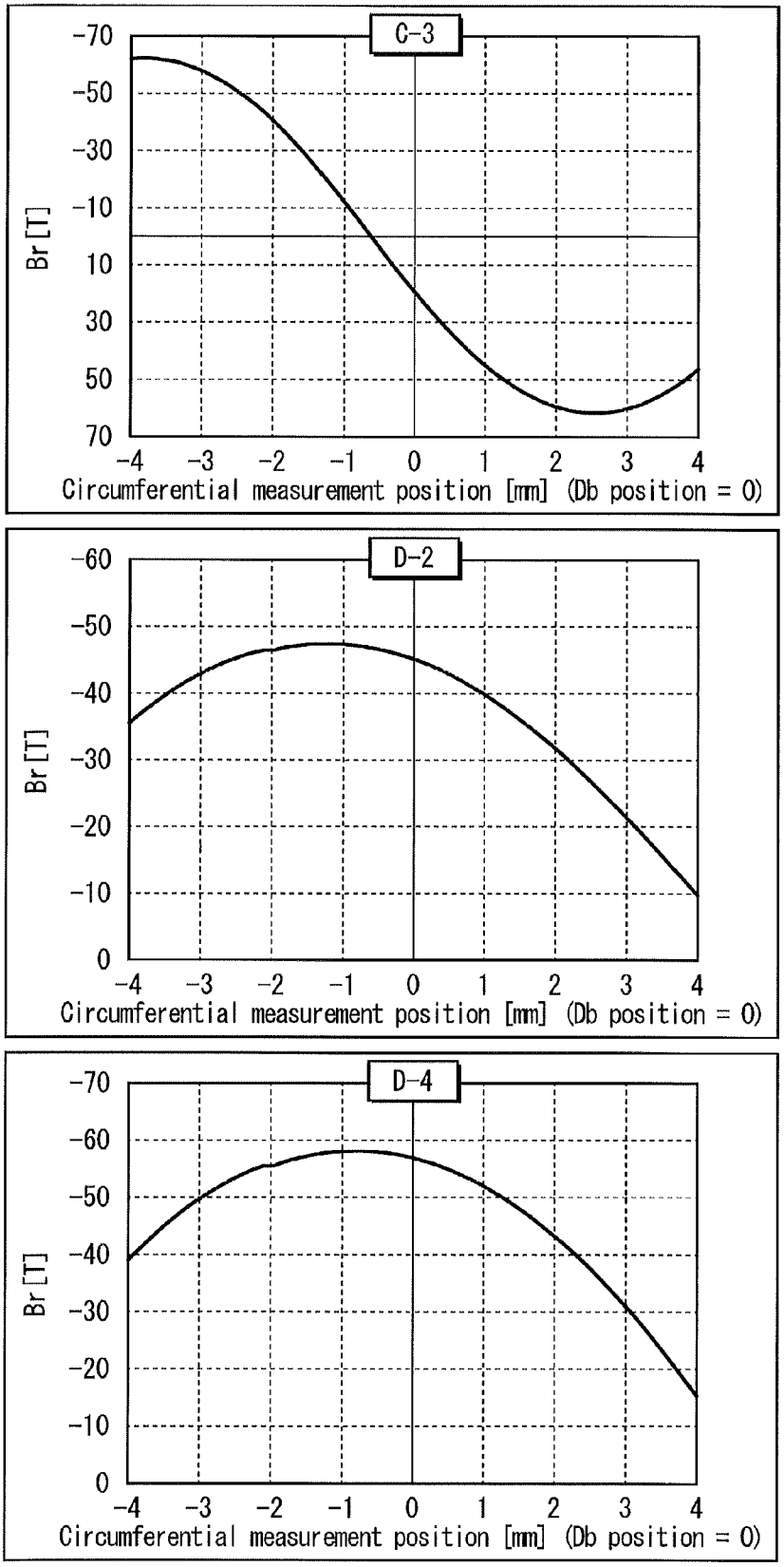
FIG. 18 shows experimental conditions C-3 through D-4 with respect to "Mg magnetic force/restriction position"

As shown in FIG. 12, the amount of the transportation of the developer in the comparative example decreases as the T/C ratio increases, whereas the amount of the transportation of the developer in the present embodiment is almost constant independently from the T/C ratio. That is, the present embodiment can make the amount of the transportation of the developer constant independently from the change of the T/C ratio, and can prevent the degradation of the image quality caused by the change of the amount of the transportation of the developer.

[4] Effective Range of Average Density $|B_m|$

According to the embodiment described above, it is assumed that the average density $|B_m|$ is 62 mT. The following shows the results of an experiment conducted for determining the effective range of the average density $|B_m|$ for reducing the change in the amount of the transportation of the developer.

In the experiment, "the average density $|B_m|$" was obtained under different conditions in terms of "the outside diameter of the developing sleeve 211", "the shape of the restriction member 220", "the particle size of the magnetic carrier" and "the Mg magnetic force/restriction position", and "the occurrence frequency of the carrier adhesion" and "the change rate in the amount of transportation of the developer" were studied. FIG. 13 is a table showing the values of "the average density $|B_m|$", "the occurrence frequency of the carrier adhesion", and "the change rate of the amount of the transportation of the developer" obtained under the different conditions.

Note that the condition of "the Mg magnetic force/restriction position" relates to the magnetic force distribution in the vicinity of the closest point to the restriction member 220. FIGS. 14 through 18 show graphs specifically representing conditions for the "the Mg magnetic force/restriction position", namely conditions A-1 through D-4. The horizontal axis of each graph shows the position in the circumferential direction of the developing sleeve 211, and the closest point to the restriction member 220 is represented as 0 mm. Positions located downstream in the rotational direction of the developing sleeve 211 are represented by positive values, and positions located upstream from the developing sleeve 211 are represented by negative values. The vertical axis of each graph represents the radial direction component of the magnetic flux density Br at the height of 0.1 mm from the outer circumferential surface of the developing sleeve 211, which are measurement values under the condition that the restriction member 220 is absent.

"The occurrence frequency of the carrier adhesion" was evaluated by printing fifty A4 sheets entirely occupied by a solid image and fifty blank sheets, for both the case where the T/C ratio is of 1% and the case where the T/C ratio is 9%. "The change rate of the amount of the transportation of the developer" shows the change rate of the amount (volume) of the developer transported by the developing sleeve 211 from when the T/C ratio is 1% to when the T/C ratio is 9%. "N/A" means that no result was obtained. Therefore, the data with "the occurrence frequency of the carrier adhesion" being "N/A" is not plotted on the graph shown in FIG. 19, and the data with "the change rate of the amount of the transportation of the developer" being "N/A" is not plotted on the graph shown in FIG. 20.

Figure 19:
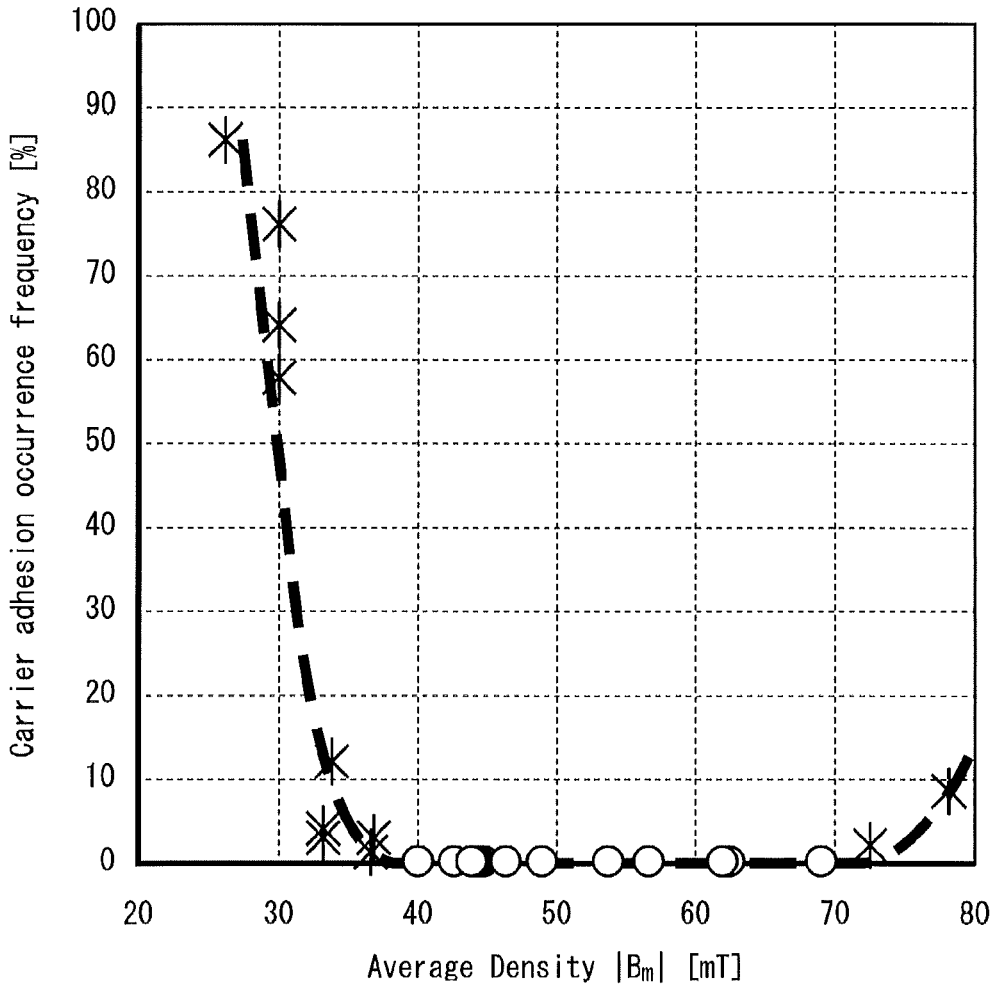
FIG. 19 is a graph showing the relationship between the average density $|B_m|$ and the occurrence frequency of the carrier adhesion.

FIG. 19 is a graph showing the relationship between the average density $|B_m|$ and the occurrence frequency of the carrier adhesion. The horizontal axis indicates the average density $|B_m|$ and the vertical axis indicates the occurrence frequency of the carrier adhesion. As shown in FIG. 19, the occurrence frequency of the carrier adhesion steeply increases when the average density $|B_m|$ becomes smaller than 40 mT. This tendency is particularly notable when the T/C ratio is 1%. Also, the occurrence frequency of the carrier adhesion steeply increases when the average density $|B_m|$ exceeds 70 mT. This tendency is particularly notable when the T/C ratio is 9%.

When the average density $|B_m|$ is within the range of 40 mT to 70 mT, the occurrence frequency of the carrier adhesion is almost 0%. Therefore, in order to prevent the carrier adhesion due to the change in the T/C ratio, it is effective to set the average density $|B_m|$ within the range of 40 mT to 70 mT. This effect of the prevention is independent from the outside diameter of the developing sleeve 211, the shape of the restriction member 220, the particle size of the magnetic carrier, or the position of the Mg magnetic force restriction position.

When the width of the restriction area 700 in the circumferential direction of the developing sleeve 211 is 2 mm, the relationship between the average density $|B_m|$ and the occurrence frequency of the carrier adhesion can be optimized as shown in FIG. 19. In other words, it is possible to clarify when the occurrence frequency of the carrier adhesion becomes low by setting the average density $|B_m|$ of the restriction area 700 at the time the width of the developing sleeve 211 in the circumferential direction is 2 mm is used as the index value.

Figure 20:
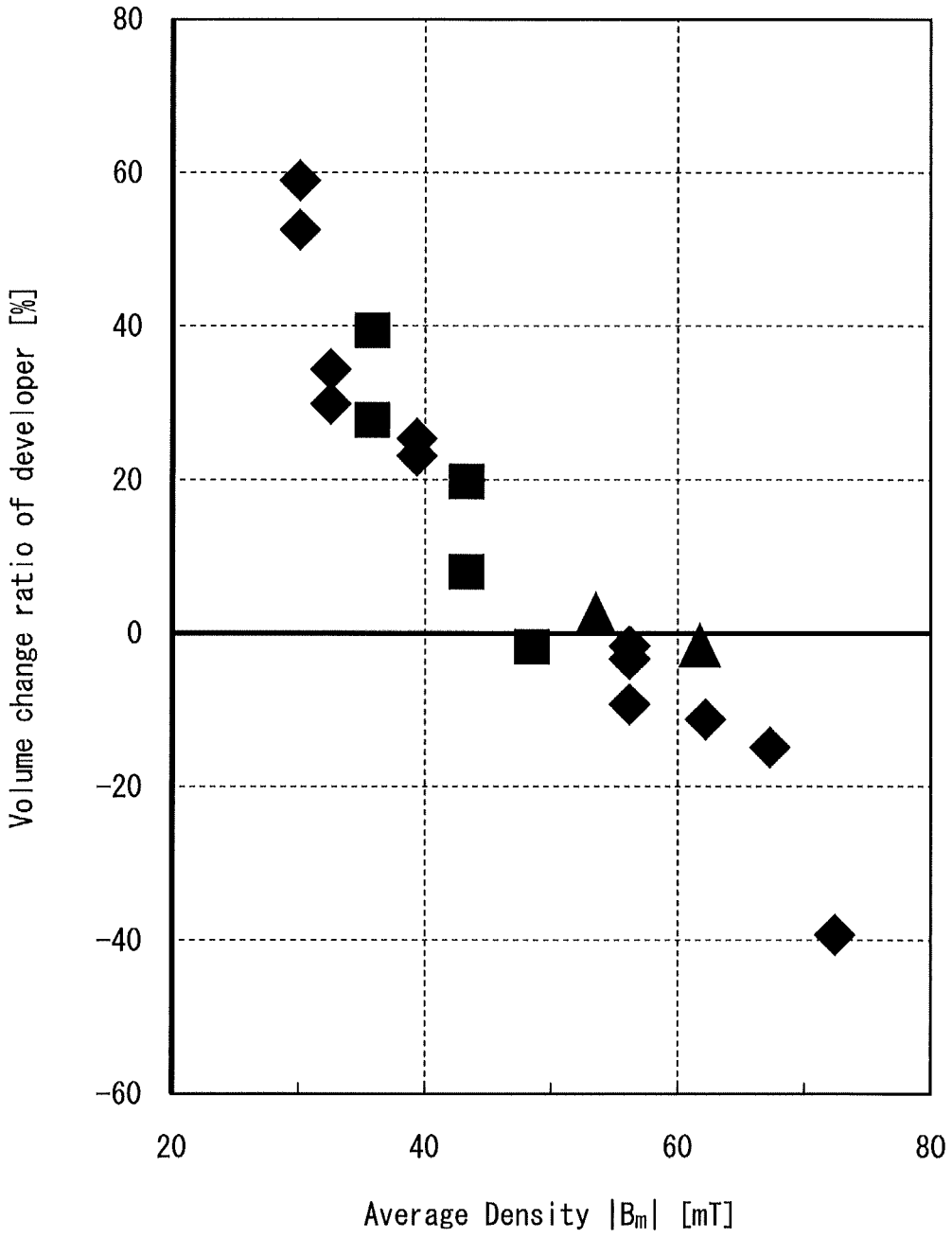
FIG. 20 is a graph showing the relationship between the average density $|B_m|$ and the volume change ratio of the developer.

The reason why the average density $|B_m|$ within the range from 40 mT to 70 mT is desirable can be explained in terms of the amount of the transportation of the developer. FIG. 20 is a graph showing the relationship between the average density $|B_m|$ and the volume change rate of the developer. In this drawing, the diamonds show measurement values under the condition that the developing sleeve 211 has an outside diameter of 16 nun and the restriction member 220 is plate-like, the squares show measurement values under the condition that the developing sleeve 211 has an outside diameter of 16 mm and the restriction member 220 is columnar, and the triangles show measurement values under the condition that the developing sleeve 211 has an outside diameter of 12 mm and the restriction member 220 is plate-like. As shown in FIG. 20, the volume change rate of the developer decreases as the average density $|B_m|$ increases. The graph also shows that when the average density $|B_m|$ is within the range of 40 mT to 70 mT the volume change rate is low (within the range of ±20%) and the amount of the transportation of the developer is stable. Therefore, by setting the average density $|B_m|$ within this range, it is possible to prevent problems caused by the change in the amount of the transportation of the developer, such as a problem that a portion of the developer gets stuck in the developing area or the carrier adheres to the developing area.

[5] Positional Relationship between Restriction Pole S2 and Restriction Member 220

Figure 21:
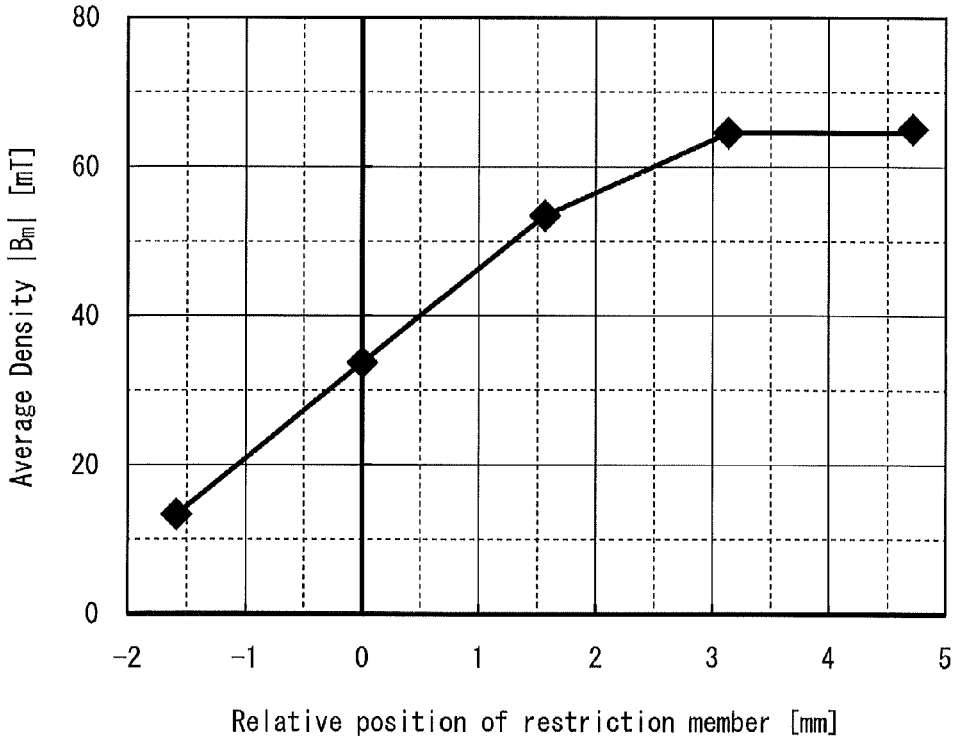
FIG. 21 is a graph showing the relationship between the relative position of the restriction member 220 to the restriction pole S2 and the average density $|B_m|$.

The average density $|B_m|$ within the restriction area 700 changes according to the positional relationship between the restriction pole S2 and the restriction member 220. FIG. 21 is a graph showing the relationship between the relative position of the restriction member 220 to the restriction pole S2, and the average density $|B_m|$. The vertical axis indicates the average density $|B_m|$ within the restriction area 700 under the condition that the restriction member 220 exists. The horizontal axis shows the position of the closest point of the restriction member 220 in the circumferential direction of the developing sleeve 211, relative to the position where the magnetic flux density generated by the restriction pole S2 is at the maximum. A position located more downstream in the rotational direction of the developing sleeve 211 (a position closer to the photosensitive drum 101) is represented by a larger value, and a position located upstream from the referential position is represented by a negative value.

As shown in FIG. 21, when the magnetic flux density generated by the restriction pole S2 is the same, the average density $|B_m|$ can be set higher by locating the restriction member 220 downstream from the referential position. Weak magnets are generally low cost. When the restriction member 220 is located downstream from the referential position, an inexpensive magnet can be used as the restriction pole S2.

[6] Calculation of Magnetic Flux Density Within Restriction Area 700

The following explains how to calculate the magnetic flux density within the restriction area 700. This calculation relies on the method disclosed in the following: Shin-ichiro SERIZAWA and Tomoyuki ITO, "Estimation of Magnetization Distribution within a Permanent Magnet for Electrophotography", Transactions of The Japan Society of Mechanical Engineers, 66-645, C(2000-5), pp. 1724-1729. In Particular, the following sections are relied on: "3. Approximate Calculation of Magnetic Field generated by Magnet" and "4. Estimation of Magnetization within Magnet".

(6-1) Magnetic Field Generated by Developing Roller 210

To calculate the average of the absolute value of the magnetic flux density $|B|$ within the restriction area 700, the radial direction component of the magnetic flux density $B_r$ is measured at the height of 100 μm from the outer circumferential surface of the developing roller (the outer circumferential surface of the developing sleeve 211) along the circumference direction of the developing roller 210. For the magnetic flux density calculation, a gaussmeter "HGM-8300" and a probe "WS-10", both manufactured by ADS, Inc, may be used. At the measurement, the distance between the outer circumferential surface of the developing roller 210 and the probe is maintained at 100 μm.

The magnetization distribution of the developing roller 210 is estimated from the magnetic flux density $B_r$ thus calculated. The magnetic field generated by the developing roller 210 is analyzed by the finite element method (FEM). The difference between the measurement values of the magnetic flux density and the magnetic flux density obtained from the estimated magnetization distribution is restricted to be less than 1%.

For this purpose, the magnetic field generated by the developing roller 210 is approximated by using a plurality of magnetic dipole moments, based on the magnetic flux density distribution measured around the developing roller 210. The magnetic field generated by the developing roller 210 is analyzed according to an optimization problem for obtaining the magnetization distribution generating a magnetic field that is equivalent to the approximated magnetic field.

Since the developing roller 210 generates a uniform magnetic field along the rotational axis, it is possible to analyze the magnetic field generated by the developing roller 210 as a static magnetic field on a two-dimensional plane that is perpendicular to the rotation shaft. Therefore, the magnetic field can be represented as follows by using a scalar potential $\phi$:

$$\frac{\partial}{\partial x}\left(v\frac{\partial\phi}{\partial x}\right)+\frac{\partial}{\partial y}\left(v\frac{\partial\phi}{\partial y}\right)=-J_m=-v_0\left(\frac{\partial M_y}{\partial x}-\frac{\partial Mx}{\partial y}\right) \quad (1)$$

$$B_x=\frac{\partial\phi}{\partial y} \quad (2)$$

$$B_y=-\frac{\partial\phi}{\partial x} \quad (3)$$

v denotes the magnetic resistivity, $v_0$ denotes the magnetic resistivity in vacuum, $J_m$ denotes the equivalent magnetizing current density, M denotes the magnetization, and B denotes the magnetic flux density. The static magnetic field analysis is performed by discretization using a first-order triangular element according to the Galerkin method.

Here, if the boundary condition is defined as $$\phi=0 \text{ at } \infty \quad (4)$$

it will be difficult to handle in the finite element method using a first-order triangular element. Therefore, on the assumption of a sufficiently large area compared to the developing roller 210, the boundary condition is defined on the boundary $\Gamma_0$ of the area, as follows:

$$\phi=0 \text{ on } \Gamma_0 \quad (5)$$

(6-2) Approximation of Magnetic Field Generated by Developing Roller 210

The following shows a method of calculating the magnetic field within the restriction area 700 from the magnetic flux density distribution measured on the outer circumferential surface of the developing roller 210. According to this method, the magnetic field is calculated by assuming that there are a plurality of magnetic dipole moments on the surface or inside the developing roller 210 and interpolating or extrapolating the actual measurement data from the overlapping magnetic fields generated by the magnetic dipole moments (c.f. Tomoyuki ITO and Hiroyuki KAWAMOTO, "Image Quality Simulation for Mono-Component Magnetic Development in Electrophotography", Transactions of The Japan Society of Mechanical Engineers, 98-8(I) (1998-8-5), pp. 287-290).

A magnetic field B generated by a magnetic dipole moment iii uniformly distributed uniformly in the rotational axis direction of the developing roller 210, at a relative position r located within a cross section (hereinafter "xy plane") perpendicular to the rotation shaft, can be represented by:

$$B_x(r)=\frac{\mu_0}{2\pi}\frac{m_x(r_x^2-r_y^2)+2m_yr_xr_y}{|r|^4} \quad (6)$$

-continued $$B_y(r)=\frac{\mu_0}{2\pi}\frac{m_y(r_y^2-r_x^2)+2m_xr_xr_y}{|r|^4} \quad (7)$$

(c.f. The Institute of Electrical Engineers of Japan, "Denjikigaku" (Electromagnetism), second edition, pp. 194-197, Ohmsha, Ltd (1979)) $\mu_0$ denotes the magnetic permeability in vacuum.

Figure 22:
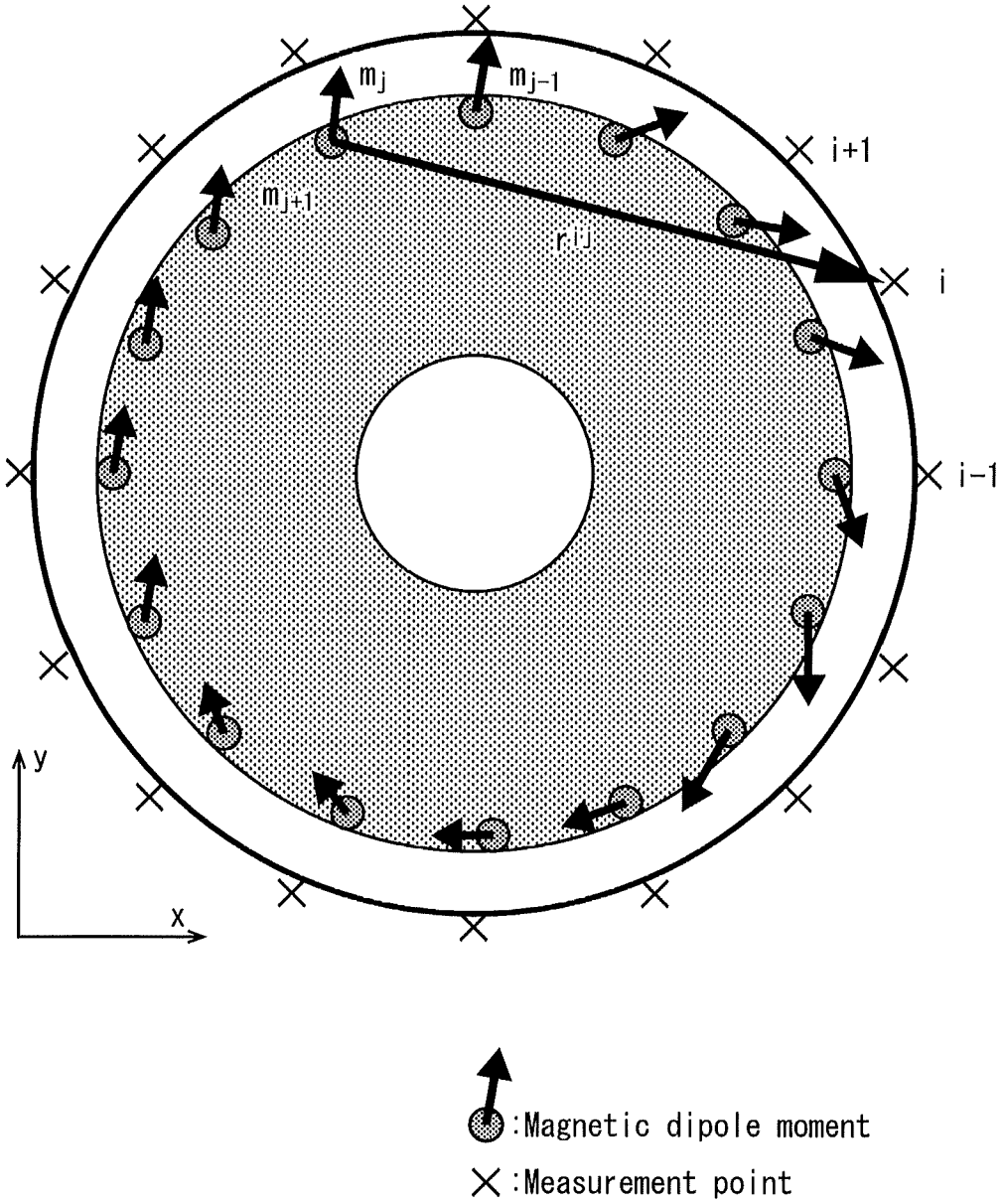
FIG. 22 is a cross-sectional view illustrating measurement points for approximating the magnetic flux density, and magnetic dipoles.

When actual measurement values are given for n measurement points in the vicinity of the outer circumferential surface of the developing roller 210, assume that n magnetic dipoles are concentrically arranged on the outer circumferential surface of or inside the developing roller 210 (see FIG. 22). When the strength of the $j^{th}$ magnetic dipole is $m_j$ and the position vector from the $j^{th}$ magnetic dipole to the $i^{th}$ measurement point is $r^{ij}$, the magnetic flux density $B^i$ at the $i^{th}$ measurement point is represented by $$B_x^i=\sum_{j=1}^{n}C_{x1}^{ij}m_x^i-\sum_{j=1}^{n}C_{x2}^{ij}m_y^i \quad (8)$$

$$B_x^i=\sum_{j=1}^{n}C_{y1}^{ij}m_x^i-\sum_{j=1}^{n}C_{y2}^{ij}m_y^i \quad (9)$$

Here, the coefficients $C_{x1}$, $C_{x2}$, $C_{y1}$ and $C_{y2}$ are represented by using the position vector $r^{ij}$ as follows:

$$C_{x1}^{ij}=C_{y2}^{ij}=\frac{2\{(r_x^{ij})^2-(r_y^{ij})^2\}}{|r^{ij}|^4} \quad (10)$$

$$C_{x2}^{ij}=C_{y1}^{ij}=\frac{4r_x^{ij}r_y^{ij}}{|r^{ij}|^4} \quad (11)$$

When the coordinates of the locations of the magnetic dipoles and the measurement points and the magnetic flux density $B^i$ at the measurement points are known, simultaneous linear equations with 2n unknowns can be obtained for the n magnetic dipole moments. By solving the equations, it is possible to obtain the strength m of every magnetic dipole and to represent the magnetic flux density B at any given point.

(6-3) Example Analysis

Figure 23:
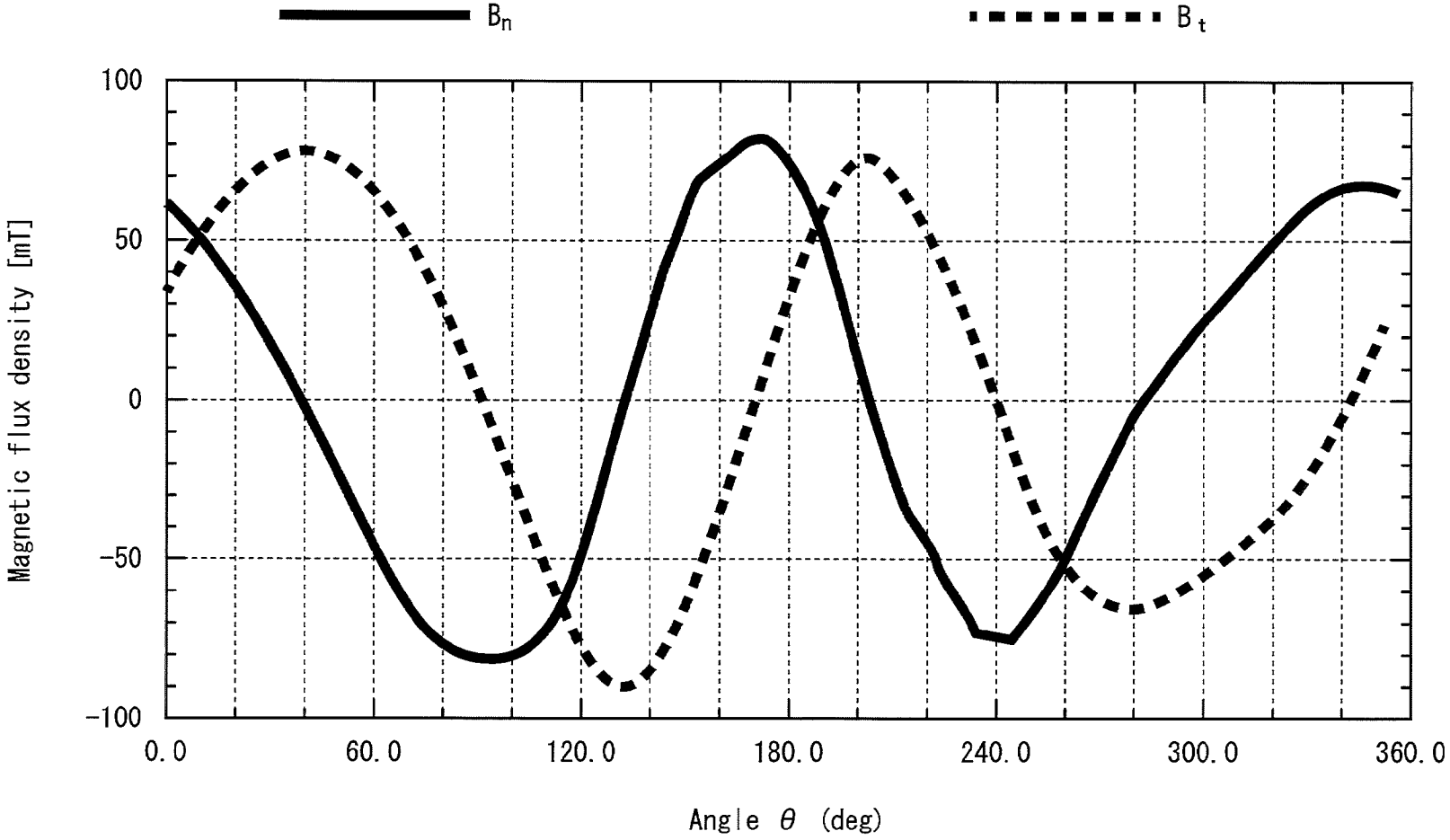
FIG. 23 is a graph illustrating the magnetic flux density distribution on the outer circumferential surface of the developing sleeve 211.
Figure 24:
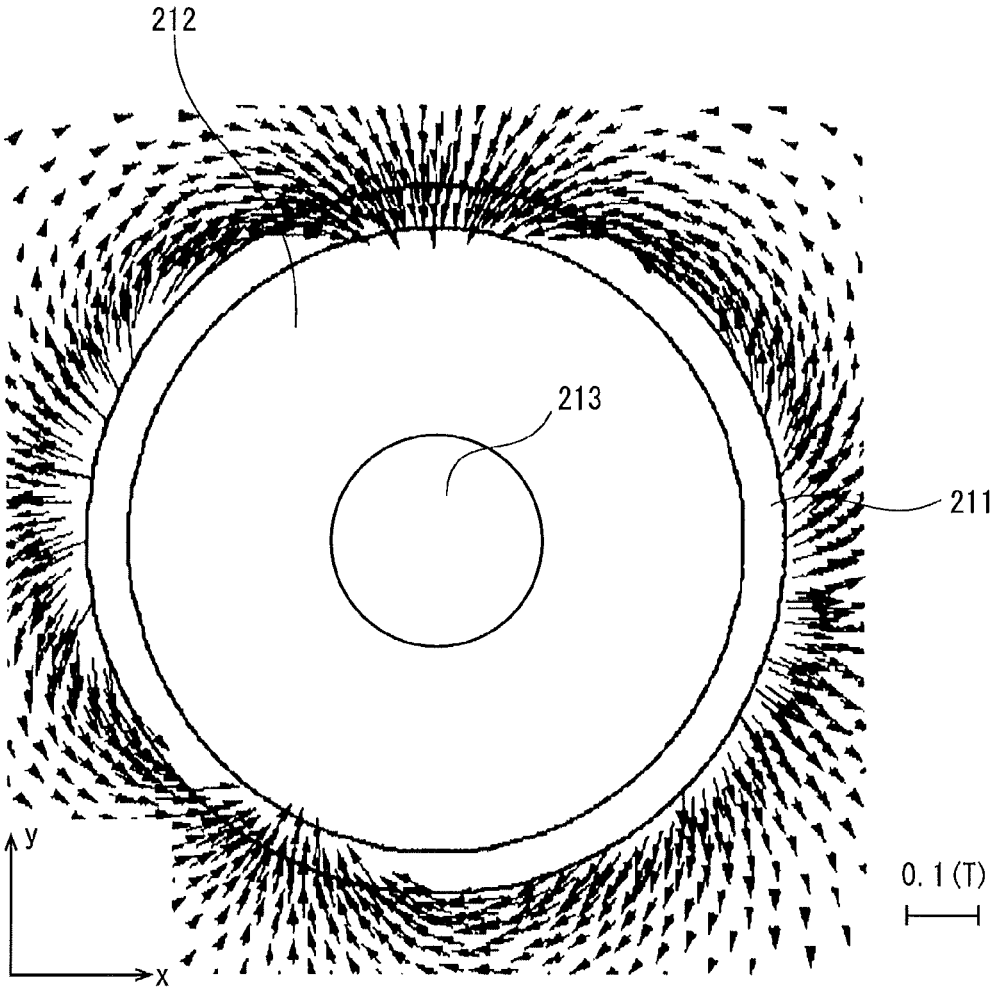
FIG. 24 illustrates magnetic flux density $B_{App}$ approximated from magnetic dipole moment.

As an example analysis using the above-described method, FIG. 24 shows magnetic flux density distribution calculated from the magnetic flux density distribution (normal direction component $B_n$ and tangential direction component $B_t$) on the outer circumferential surface of the developing sleeve 211 shown in FIG. 23. Note that the magnetic flux density inside the developing sleeve 211 is omitted from FIG. 24.

To evaluate the magnetic flux density $B_{App}$ obtained from the result of the approximation, the error in the result of the analysis by the finite element method is defined as follows.

$$\Delta B_{App}=\frac{|B_0-B_{App}|}{|B_0|}\times 100 \quad (12)$$

Figure 25:
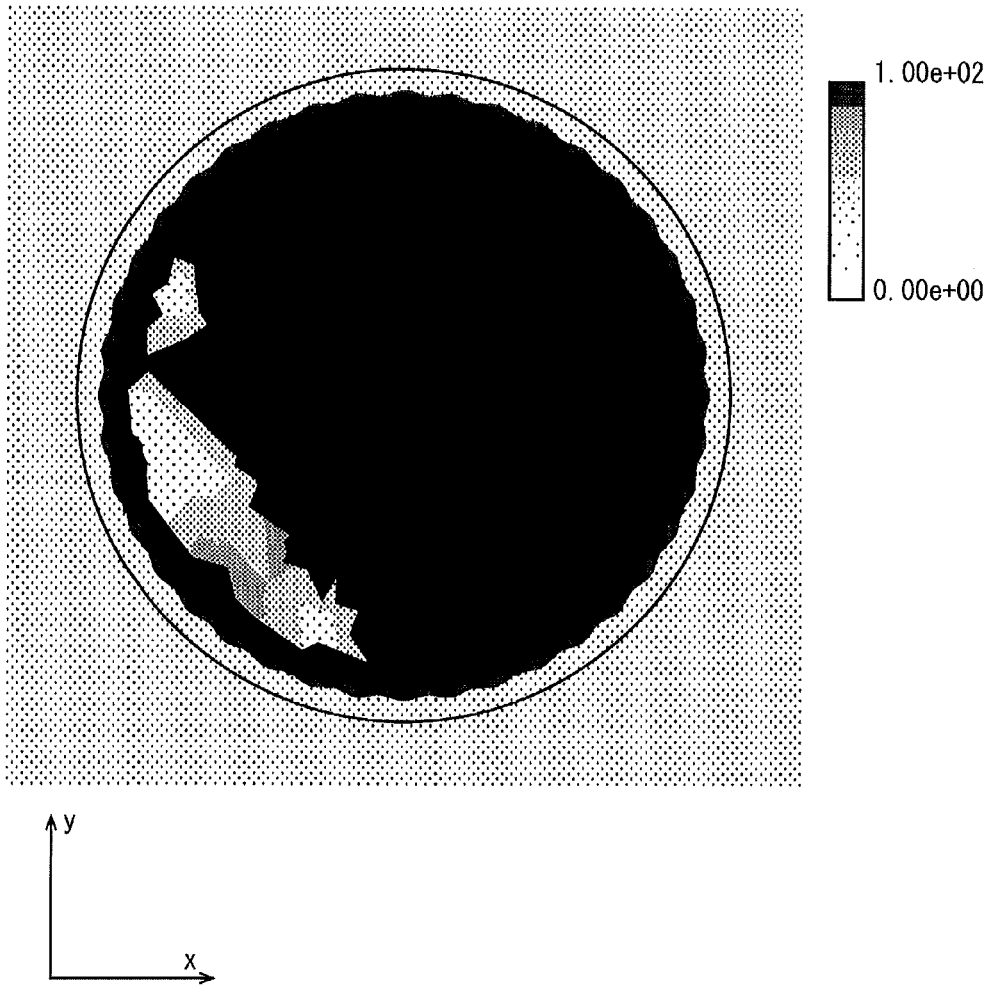
FIG. 25 shows error distribution of magnetic flux density $B_{App}$ approximated from magnetic dipole moment.

FIG. 25 shows the distribution of the error. The error is extremely large inside the developing sleeve 211. However, the magnetic flux density to be considered for the practical use of the developing device is outside the sleeve, and the error occurring outside the sleeve is generally less than 10%.

Therefore, it can be concluded that the magnetic field outside the developing sleeve 211 calculated by the method described above is appropriate and suitable for practical use.

(6-4) Estimation of Magnetization Within Developing Roller 210

(6-4-1) Estimation of Magnetization as Optimization Problem

As described above, with the use of the plurality of magnetic dipoles, the magnetic field generated by the developing roller 210 can be calculated with high precision from the magnetic flux density distribution on the outer circumferential surface of the developing roller 210. Considering this, the magnetization distribution of the developing roller 210 can be estimated by calculating the magnetization that generates magnetic flux density distribution that coincides with approximated magnetic flux density distribution.

First, as the objective function for evaluating the appropriateness of the estimated magnetization distribution, suppose the sum of squares of the error in the estimated magnetic flux density $B_{App}$ calculated by using the result B of the analysis by the finite element method and the magnetic dipoles, as follows.

$$J = \frac{1}{2}\int\int_A w\{(B_x - (B_{App})_x)^2 + (B_y - (B_{App})_y)^2\}dxdy = \frac{1}{2}\int\int_A w\left\{\left(\frac{\partial\phi}{\partial y} - (B_{App})_x\right)^2 + \left(-\frac{\partial\phi}{\partial x} - (B_{App})_y\right)^2\right\}dxdy \tag{13}$$

Here, w is a weight coefficient.

Since the static magnetic field on the two-dimensional orthogonal coordinate system is represented by the equations (1) through (3) and (5), the estimation of the magnetization can be formulated as a minimization problem with a constraint with respect to the magnetization M shown below:

minimize J with respect to M subject to Eqs. (1) through (3) and (5) (14)

(6-4-2) Estimation of Magnetization as Stationary Value Problem

With the introduction of Lagrange multiplier φ, the minimization problem (14) with a constraint can be formulated as a stationary value problem without a constraint (c.f. Hiroshi YAMAKAWA, "Saitekika Dezain" (Optimization Design), pp. 157-221, Baifukan Co., Ltd. (1993), Yoshiyuki SAKAWA, "Saitekika To Saiteki Seigyo" (Optimization and Optimum Control), pp. 149-173, Morikita publishing Co., Ltd. (1980)). The functional to be stationary is represented by $$\Pi = J(M) + \int\int_S \varphi\left\{\begin{array}{c}\frac{\partial}{\partial x}\left(v\frac{\partial\phi}{\partial x}\right) + \frac{\partial}{\partial y}\left(v\frac{\partial\phi}{\partial y}\right) + \\ v_0\left(\frac{\partial M_y}{\partial x} - \frac{\partial Mx}{\partial y}\right)\end{array}\right\}dxdy = \frac{1}{2}\int\int_A w\left\{\left(\frac{\partial\phi}{\partial x} - (B_{App})_x\right)^2 + \left(\frac{\partial\phi}{\partial y} + (B_{App})_y\right)^2\right\}dxdy + \int\int_S \varphi\left\{\begin{array}{c}\frac{\partial}{\partial x}\left(v\frac{\partial\phi}{\partial x}\right) + \frac{\partial}{\partial y}\left(v\frac{\partial\phi}{\partial y}\right) + \\ v_0\left(\frac{\partial M_y}{\partial x} - \frac{\partial Mx}{\partial y}\right)\end{array}\right\}dxdy \tag{15}$$

The stationary value problem can be reformulated as

Stationary Π

With respect to M (16)

The stationary conditions for the functional are represented by the equations (1) through (3) and (5) for a static magnetic field and the following four equations:

$$\frac{\partial}{\partial x}\left(v\frac{\partial\varphi}{\partial x}\right) + \frac{\partial}{\partial y}\left(v\frac{\partial\varphi}{\partial y}\right) = -w\left\{\begin{array}{c}\left(\frac{\partial B_y}{\partial x} + \frac{\partial (B_{App})_y}{\partial x}\right) + \\ \left(\frac{\partial Bx}{\partial y} + \frac{\partial (B_{App})x}{\partial y}\right)\end{array}\right\} \tag{17}$$

$$\varphi = 0 \text{ on } \Gamma_0 \tag{18}$$

$$\frac{\partial\varphi}{\partial x} + v_0 M_y = 0 \tag{19}$$

$$\frac{\partial\varphi}{\partial y} + v_0 M_x = 0 \tag{20}$$

When the functional Π is stationary with respect to M, the equations (1) through (4) and (17) through (20) should be satisfied. However, if M is not an appropriate value, the functional cannot be stationary. Therefore, using variations (21) and (22) for the functional, M can be modified as represented by the equation (23):

$$\delta M_x = -\frac{1}{v_0}\frac{\partial\varphi}{\partial y} \tag{21}$$

$$\delta M_y = -\frac{1}{v_0}\frac{\partial\varphi}{\partial x} \tag{22}$$

$$M = M + \alpha\delta M \tag{23}$$

Figure 26:
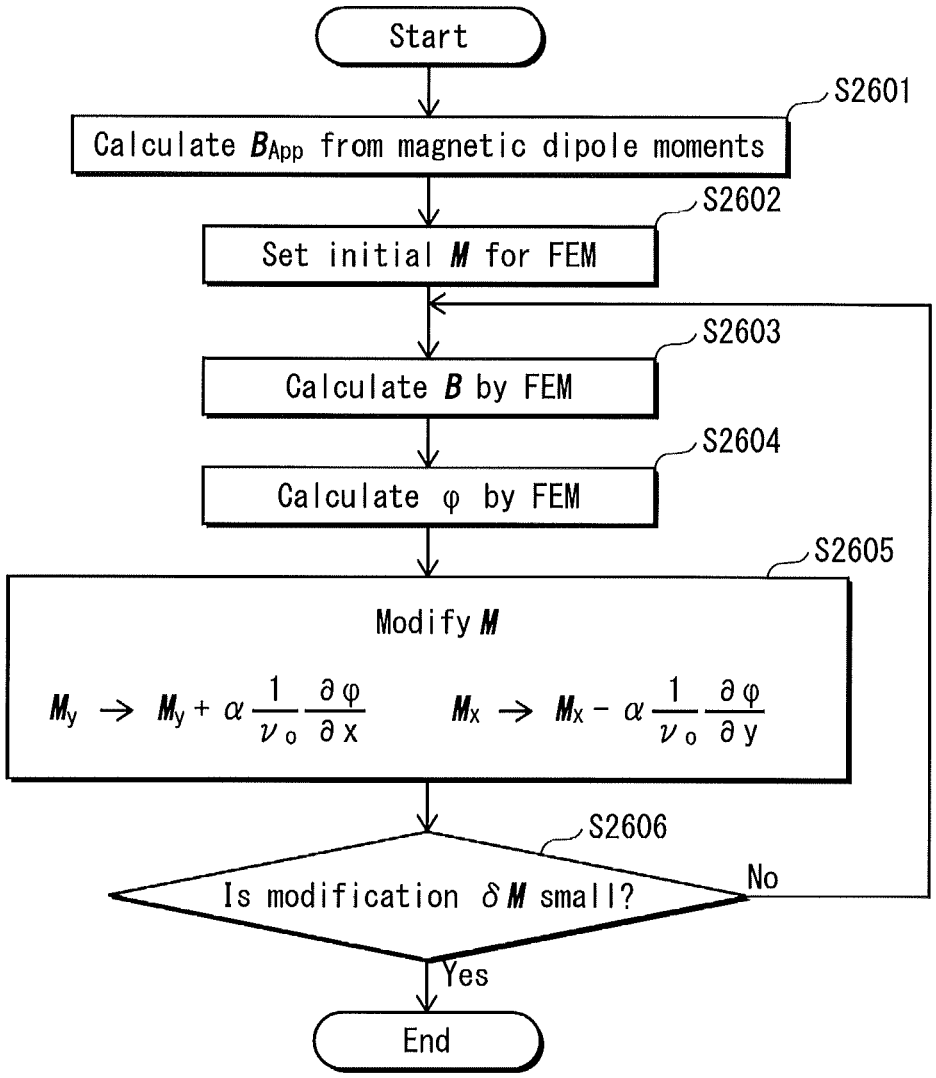
FIG. 26 is a flowchart showing procedures for estimating the magnetization distribution.
Figure 27A:
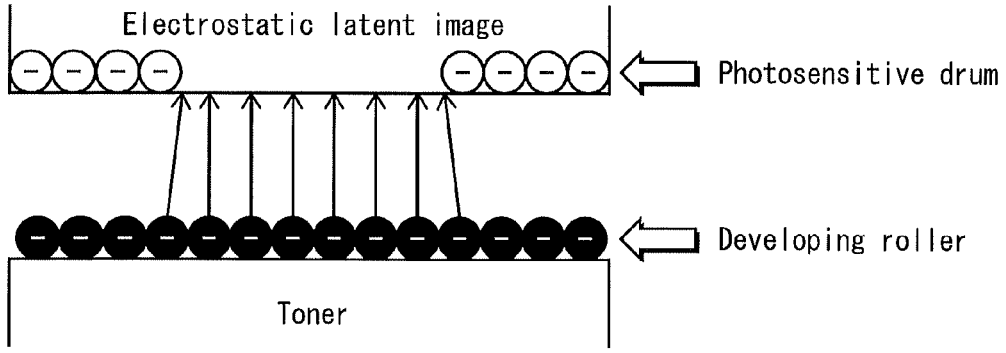
FIGS. 27A and 27B are conceptual diagrams showing an edge effect.
Figure 27B:
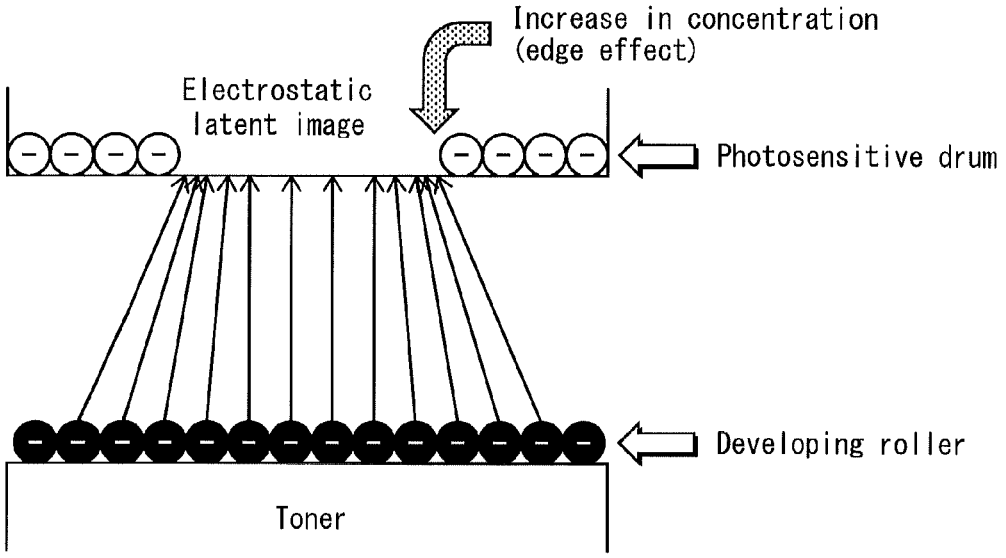

(c.f. Hiroshi YAMAKAWA, "Saitekika Dezain" (Optimization Design), pp. 157-221, Baifukan Co., Ltd. (1993), Yoshiyuki SAKAWA, "Saitekika To Saiteki Seigyo" (Optimization and Optimum Control), pp. 149-173, Morikita publishing Co., Ltd. (1980)). Here, α denotes a relaxation coefficient for the modification. FIG. 26 shows the above-described steps as S2601, S2602, S2603, S2604, S2605 and S2606 for the magnetization distribution estimation.

The average density $|B_m|$ of the restriction area 700 is obtained by calculating the magnetic flux density distribution at the time the restriction member 220 and so on in the developing device 103 are disposed, with the use of the estimated magnetic flux density $B_{App}$ obtained in Step S2601. In this case, it is desirable that the unit of calculation is smaller than 100 μm in the radial direction and smaller than 1 degree in the circumferential direction.

[7] Modification Examples

The present invention has been described above based on Embodiment. However, the present invention should not be limited to Embodiment. The following modifications are acceptable.

(1) In the embodiment above, the minimum distance Db from the restriction member 220 to the developing sleeve 211 is set to 470 μm. However, the present invention should not be limited by this particular value. The advantageous effects described above can be achieved with any value within the range of 420 μm to 520 μm.

(2) In the embodiment above, the developing sleeve 211 is rotated in the same direction as the photosensitive drum 101 when viewed in their rotational axes. However, this is not essential for the present invention. The developing sleeve 211 may be rotated in the opposite direction. Note, however, that better image quality should be obtained by rotating the developing sleeve 211 in the same direction as the photosensitive drum 101 when viewed in their rotational axes.

(3) The arrangement of the magnetic poles of the magnet roller 212 according to the embodiment above is nothing more than an example. Insofar as the average density $|B_m|$ in the restriction area 700 falls within the range according to the above-described embodiment, the same advantageous effect can be achieved even if each magnetic pole has an opposite polarity (S or N) or is arranged differently.

(4) The image forming apparatus according to the above-described embodiment is a tandem color printer. However, this is not essential for the present invention. The same advantageous effects can be achieved even when the present invention is applied to a monochrome printer. Furthermore, the same advantageous effects can be achieved even when the present invention is applied to a single-function peripheral such as a copy machine or a facsimile machine, or a multi-function peripheral (MFP) having the functions of such machines.

[8] Summary

As described above, the present invention provides a developing device for developing an electrostatic latent image on an image carrier by using two-component developer containing toner and magnetic carrier, comprising: a magnetic member having a plurality of magnetic poles along a circumferential direction of the magnetic member; a developing sleeve in which the magnetic member is inserted, transporting developer to a developing area facing the image carrier; and a restriction member made of magnetic material, disposed along a rotational axis of the developing sleeve so as to face an outer circumferential surface of the developing sleeve, and restricting the amount of developer to be transported to the developing area to be no greater than 250 g/m$^2$, wherein the magnetic member generates magnetic flux such that an average of absolute values of magnetic flux density within a restriction area falls within a range of 40 mT to 70 mT under a condition that no developer exists within the restriction area, the restriction area extending along the outer circumferential surface between a closest point on the outer circumferential surface, which is closest to the restriction member, and a point 2 mm upstream from the closest point in a rotational direction of the developing sleeve, and having a height that is half a minimum distance between the closest point and the restriction member.

With the stated structure, the magnetic member generates magnetic flux such that an average of absolute values of magnetic flux density within a restriction area falls within a range of 40 mT to 70 mT under a condition that no developer exists within the restriction area, the restriction area extending along the outer circumferential surface between a closest point on the outer circumferential surface, which is closest to the restriction member, and a point 2 mm upstream from the closest point in a rotational direction of the developing sleeve, and having a height that is half a minimum distance between the closest point and the restriction member. Therefore, the present invention is capable of restricting the amount of transportation of developer according to the T/C ratio without moving the restriction member or rotating the magnetic member.

In this structure, it is desirable that the minimum distance between the closest point and the restriction member is within a range of 420 μm to 520 μm.

Furthermore, when the restriction member is located downstream in the rotational direction of the developing sleeve from a point at which a radial direction component, in a radial direction of the developing sleeve, of a density of magnetic flux generated by one of the plurality of magnetic poles that is closest to the restriction member is greatest among points for measuring the density arranged in the circumferential direction, the density of the magnetic flux generated by the magnetic pole closest to the restriction member can be not large. Therefore, it is possible to use an inexpensive magnet as the magnetic member, and thereby reduce the material cost of the magnetic member.

When the developing sleeve and the image carrier are rotated in the same direction when viewed along rotational axes of the developing sleeve and the image carrier, the stated structure improves the quality of the toner image obtained by developing the electrostatic latent image.

An image forming apparatus pertaining to the present invention is an image forming apparatus comprising: a developing device for developing an electrostatic latent image on an image carrier by using two-component developer containing toner and magnetic carrier, the developing device comprising: a magnetic member having a plurality of magnetic poles along a circumferential direction of the magnetic member; a developing sleeve in which the magnetic member is inserted, transporting developer to a developing area facing the image carrier; and a restriction member made of magnetic material, disposed along a rotational axis of the developing sleeve so as to face an outer circumferential surface of the developing sleeve, and restricting the amount of developer to be transported to the developing area to be no greater than 250 g/m$^2$, wherein the magnetic member generates magnetic flux such that an average of absolute values of magnetic flux density within a restriction area falls within a range of 40 mT to 70 mT under a condition that no developer exists within the restriction area, the restriction area extending along the outer circumferential surface between a closest point on the outer circumferential surface, which is closest to the restriction member, and a point 2 mm upstream from the closest point in a rotational direction of the developing sleeve, and having a height that is half a minimum distance between the closest point and the restriction member. The stated structure achieves the advantageous effects as described above.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A developing device for developing an electrostatic latent image on an image carrier by using two-component developer containing toner and magnetic carrier, comprising:

a magnetic member having a plurality of magnetic poles along a circumferential direction of the magnetic member;

a developing sleeve in which the magnetic member is inserted, transporting developer to a developing area facing the image carrier; and a restriction member made of magnetic material, disposed along a rotational axis of the developing sleeve so as to face an outer circumferential surface of the developing sleeve, and restricting the amount of developer to be transported to the developing area to be no greater than 250 g/m$^2$, wherein the magnetic member generates magnetic flux such that an average of absolute values of magnetic flux density within a restriction area falls within a range of 40 mT to 70 mT under a condition that no developer exists within the restriction area, the restriction area extending along the outer circumferential surface between a closest point on the outer circumferential surface, which is closest to the restriction member, and a point 2 mm upstream from the closest point in a rotational direction of the developing sleeve, and having a height that is half a minimum distance between the closest point and the restriction member.

2. The developing device of claim 1, wherein the minimum distance between the closest point and the restriction member is within a range of 420 μm to 520 μm.

3. The developing device of claim 1, wherein the restriction member is located downstream in the rotational direction of the developing sleeve from a point at which a radial direction component, in a radial direction of the developing sleeve, of a density of magnetic flux generated by one of the plurality of magnetic poles that is closest to the restriction member is greatest among points for measuring the density arranged in the circumferential direction.

4. The developing device of claim 1, wherein the developing sleeve and the image carrier are rotated in the same direction when viewed along rotational axes of the developing sleeve and the image carrier.

5. An image forming apparatus comprising:

a developing device for developing an electrostatic latent image on an image carrier by using two-component developer containing toner and magnetic carrier, the developing device comprising:

a magnetic member having a plurality of magnetic poles along a circumferential direction of the magnetic member;

a developing sleeve in which the magnetic member is inserted, transporting developer to a developing area facing the image carrier; and a restriction member made of magnetic material, disposed along a rotational axis of the developing sleeve so as to face an outer circumferential surface of the developing sleeve, and restricting the amount of developer to be transported to the developing area to be no greater than 250 $g/m^2$, wherein the magnetic member generates magnetic flux such that an average of absolute values of magnetic flux density within a restriction area falls within a range of 40 mT to 70 mT under a condition that no developer exists within the restriction area, the restriction area extending along the outer circumferential surface between a closest point on the outer circumferential surface, which is closest to the restriction member, and a point 2 mm upstream from the closest point in a rotational direction of the developing sleeve, and having a height that is half a minimum distance between the closest point and the restriction member.

* * * * *